US008303094B2

(12) United States Patent
Furukawa et al.

(10) Patent No.: US 8,303,094 B2
(45) Date of Patent: Nov. 6, 2012

(54) LIQUID SUPPLY APPARATUS, IMAGE FORMING APPARATUS AND LIQUID SUPPLY METHOD

(75) Inventors: Gentaro Furukawa, Kanagawa-ken (JP); Toshiya Kojima, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 1482 days.

(21) Appl. No.: 11/819,141

(22) Filed: Jun. 25, 2007

(65) Prior Publication Data

US 2008/0007579 A1 Jan. 10, 2008

(30) Foreign Application Priority Data

Jul. 5, 2006 (JP) ..... 2006-185726

(51) Int. Cl.
*B41J 2/175* (2006.01)
*B41J 2/17* (2006.01)

(52) U.S. Cl. ..... 347/85; 347/84

(58) Field of Classification Search ..... 347/5, 6, 347/19, 84–85
See application file for complete search history.

(56) References Cited

U.S. PATENT DOCUMENTS 5,479,198 A * 12/1995 Kawano et al. ..... 347/86
6,082,851 A 7/2000 Shihoh et al.
6,280,408 B1 * 8/2001 Sipin ..... 604/65
2002/0024543 A1 2/2002 Kimura et al.
2004/0090501 A1 * 5/2004 Yoshida et al. ..... 347/85
2005/0024412 A1 * 2/2005 Hudd et al. ..... 347/19
2005/0068383 A1 * 3/2005 Matsuda et al. ..... 347/85
2005/0219282 A1 10/2005 Kachi
2006/0132554 A1 * 6/2006 Ota et al. ..... 347/85
2006/0215000 A1 * 9/2006 Kachi ..... 347/85
2008/0055378 A1 * 3/2008 Drury et al. ..... 347/92

FOREIGN PATENT DOCUMENTS

JP 11-348300 A 12/1999
JP 2001-270133 A 10/2001
JP 2002-1978 A 1/2002
JP 2004-202797 A 7/2004
JP 2005-280246 A 10/2005

* cited by examiner

*Primary Examiner* — Mark Robinson
*Assistant Examiner* — Hung Lam
(74) *Attorney, Agent, or Firm* — Birch, Stewart, Kolasch & Birch, LLP

(57) ABSTRACT

The liquid supply apparatus has: a main tank which stores liquid; a sub tank which is disposed vertically above a recording head configured to eject the liquid and which is not connected to atmosphere, the sub tank being composed of a deformable member so that a volume of the sub tank is changed depending on a volume of the liquid in the sub tank; a first flow channel which connects the main tank with the sub tank; a second flow channel which connects the sub tank with the recording head; a flow rate determination device which determines a flow rate of the liquid in the second flow channel; a first pressure control device which controls an internal pressure of the main tank according to the flow rate determined by the flow rate determination device; and a second pressure control device which controls an internal pressure of the sub tank so as to fall within a prescribed range.

17 Claims, 25 Drawing Sheets

LIQUID SUPPLY APPARATUS, IMAGE FORMING APPARATUS AND LIQUID SUPPLY METHOD

BACKGROUND OF THE INVENTION

1. Field of the Invention

The present invention relates to a liquid supply apparatus, an image forming apparatus and a liquid supply method, and more particularly, to a liquid supply apparatus, an image forming apparatus and a liquid supply method in which ink is supplied to a recording head from a main tank via a sub tank.

2. Description of the Related Art

An inkjet recording apparatus has been commonly known which records an image on a recording medium by ejecting ink droplets from a plurality of ejection ports (nozzles) formed in a recording head, while moving the recording head and the recording medium relatively to each other.

A method of supplying ink to the recording head has been widely used in which ink is supplied to the recording head from a main tank, via a sub tank. In this liquid supply method, it is possible to reduce variation of internal pressure in the recording head, and hence to improve the ejection stability of the recording head.

For example, Japanese Patent Application Publication No. 11-348300 discloses a method in which a sensor which measures ink level in a sub tank is provided so as to monitor the ink level and the negative pressure in the recording head is maintained by keeping the ink level within a target range. In this method, it is possible to carry out an ink replenishment operation to the sub tank, even when the recording head is being driven.

Moreover, Japanese Patent Application Publication No. 2002-001978 discloses a method in which the pressure in the sub tank is measured, and liquid is replenished from the main tank on the basis of the measured pressure.

However, with the improvement of image quality and the increase in recording speeds in recent years, the amount of ink consumed by the recording head has tended to increase, and the following problems have arisen with the methods described in Japanese Patent Application Publication Nos. 11-348300 and 2002-001978.

Firstly, in the method described in Japanese Patent Application Publication No. 11-348300, since the flow channel connecting the sub tank with the recording head is long, then the pressure loss is liable to become large depending on the increase in the flow rate from the sub tank to the recording head, and moreover, opening and closing of the valves in ink supply operation are liable to cause the pressure variation. Consequently, ejection characteristics of the recording head are liable to become instable.

Moreover, in the method described in Japanese Patent Application Publication No. 2002-001978, the recording operation (ejection operation) performed by the recording head is required to be halted before replenishing ink, and therefore, it is difficult to achieve higher-speed recording.

SUMMARY OF THE INVENTION

The present invention has been contrived in view of the foregoing circumstances, an object thereof being to provide a liquid supply apparatus, an image forming apparatus and a liquid supply method whereby liquid can be supplied to the recording head in a stable manner, even during a recording operation, and stable ejection in the recording head can be achieved.

In order to attain the aforementioned object, the present invention is directed to a liquid supply apparatus comprising: a main tank which stores liquid; a sub tank which is disposed vertically above a recording head configured to eject the liquid and which is not connected to atmosphere, the sub tank being composed of a deformable member so that a volume of the sub tank is changed depending on a volume of the liquid in the sub tank; a first flow channel which connects the main tank with the sub tank; a second flow channel which connects the sub tank with the recording head; a flow rate determination device which determines a flow rate of the liquid in the second flow channel; a first pressure control device which controls an internal pressure of the main tank according to the flow rate determined by the flow rate determination device; and a second pressure control device which controls an internal pressure of the sub tank so as to fall within a prescribed range.

In this aspect of the present invention, by means of the first pressure control device, it is possible to change the volume of the ink supplied from the main tank to the sub tank in accordance with the increase or decrease in the amount of ink consumed by the recording head, and therefore it is possible to suppress sudden pressure variations in the sub tank. Moreover, by means of the second pressure control device, it is possible to keep the internal pressure of the recording head within a prescribed range, irrespective of the magnitude of the pressure loss in the first flow channel. Consequently, it is possible to supply ink to the recording head in a stable fashion, even during a recording operation, and it is also possible to achieve stable ejection of the recording head.

A method which "determines a flow rate of the liquid in the second flow rate" includes methods which measure the flow rate directly, such as a propeller wheel method (an impeller method) in which a propeller is provided in the second flow channel and the number of rotations of the propeller is measured, a floater method in which a floating member is provided and the flow rate is measured on the basis of the level of elevation of the floating member, and a pressure differential method which measures the pressure differential between two points and then calculates the flow rate on the basis of Bernoulli's theorem. The method which "determines a flow rate of the liquid in the second flow rate" also includes methods which determine the flow rate indirectly, such as, for instance, a method which calculates the sum total of the ejection volume on the basis of dot data obtained from the input image data, and then determines (estimates) the ejection volume per unit time period, namely, the flow rate.

Preferably, the liquid supply apparatus further comprises a liquid volume measurement device which measures the volume of the liquid in the sub tank, wherein the first pressure control device controls the internal pressure of the main tank according to the volume of the liquid measured by the liquid volume measurement device.

In this aspect of the present invention, even in a case where there is an error in the flow rate determined by the flow rate determination device, it is still possible to keep the liquid volume in the sub tank within a prescribed range, and therefore it is possible to supply ink to the recording head in a stable fashion.

Preferably, the liquid supply apparatus further comprises an operational history storage device which stores an operational history of the second pressure control device, wherein the first pressure control device controls the internal pressure of the main tank according to the operational history stored in the operational history storage device.

In this aspect of the present invention, it is possible to calculate the amount of change in the volume of liquid in the sub tank, on the basis of the storage contents (i.e., the operational history of the second pressure control device) of the operational history storage device, and therefore, it is possible to obtain beneficial effects similar to those of the above-described aspect with the liquid volume measurement device even if the liquid volume measurement device for measuring the volume of liquid in the sub tank is not provided. Consequently, it is possible to reduce the cost and the size of the liquid supply apparatus.

Preferably, the liquid supply apparatus further comprises a temperature measurement device which measures a temperature of the liquid in the first flow channel, wherein the first pressure control device controls the internal pressure of the main tank according to the temperature of the liquid measured by the temperature measurement device.

In this aspect of the present invention, even in cases where the liquid viscosity changes due to a change in the liquid temperature, and hence a change occurs in the pressure loss in the first flow channel, it is possible to achieve stable ink supply by controlling the internal pressure in the main tank in accordance with the liquid temperature measured by the temperature measurement device.

In order to attain the aforementioned object, the present invention is also directed to an image forming apparatus comprising any one of the above-described liquid supply apparatuses.

In order to attain the aforementioned object, the present invention is also directed to a liquid supply method for a liquid supply apparatus including: a main tank which stores liquid; a sub tank which is disposed vertically above a recording head configured to eject the liquid and which is not connected to atmosphere, the sub tank being composed of a deformable member so that a volume of the sub tank is changed depending on a volume of the liquid in the sub tank; a first flow channel which connects the main tank with the sub tank; and a second flow channel which connects the sub tank with the recording head, the liquid supply method comprising the steps of; determining a flow rate of the liquid in the second flow channel; controlling an internal pressure of the main tank according to the determined flow rate of the liquid in the second flow channel; and controlling an internal pressure of the sub tank so as to fall within a prescribed range.

According to the present invention, by means of the first pressure control device, it is possible to change the ink supply volume from the main tank to the sub tank in accordance with the increase or decrease in the amount of ink consumed by the recording head, and therefore it is possible to suppress sudden pressure variations inside the sub tank. Further, by means of the second pressure control device, it is possible to keep the internal pressure of the recording head within a prescribed range, irrespective of the magnitude of the pressure loss between the main tank and the sub tank. Consequently, it is possible to supply ink to the recording head in a stable fashion even during a recording operation, and it is also possible to achieve stable ejection from the recording head.

BRIEF DESCRIPTION OF THE DRAWINGS

The nature of this invention, as well as other objects and benefits thereof, will be explained in the following with reference to the accompanying drawings, in which reference characters designate the same or similar parts throughout the figures and wherein.

DETAILED DESCRIPTION OF THE PREFERRED EMBODIMENTS

First Embodiment

Figure 1:
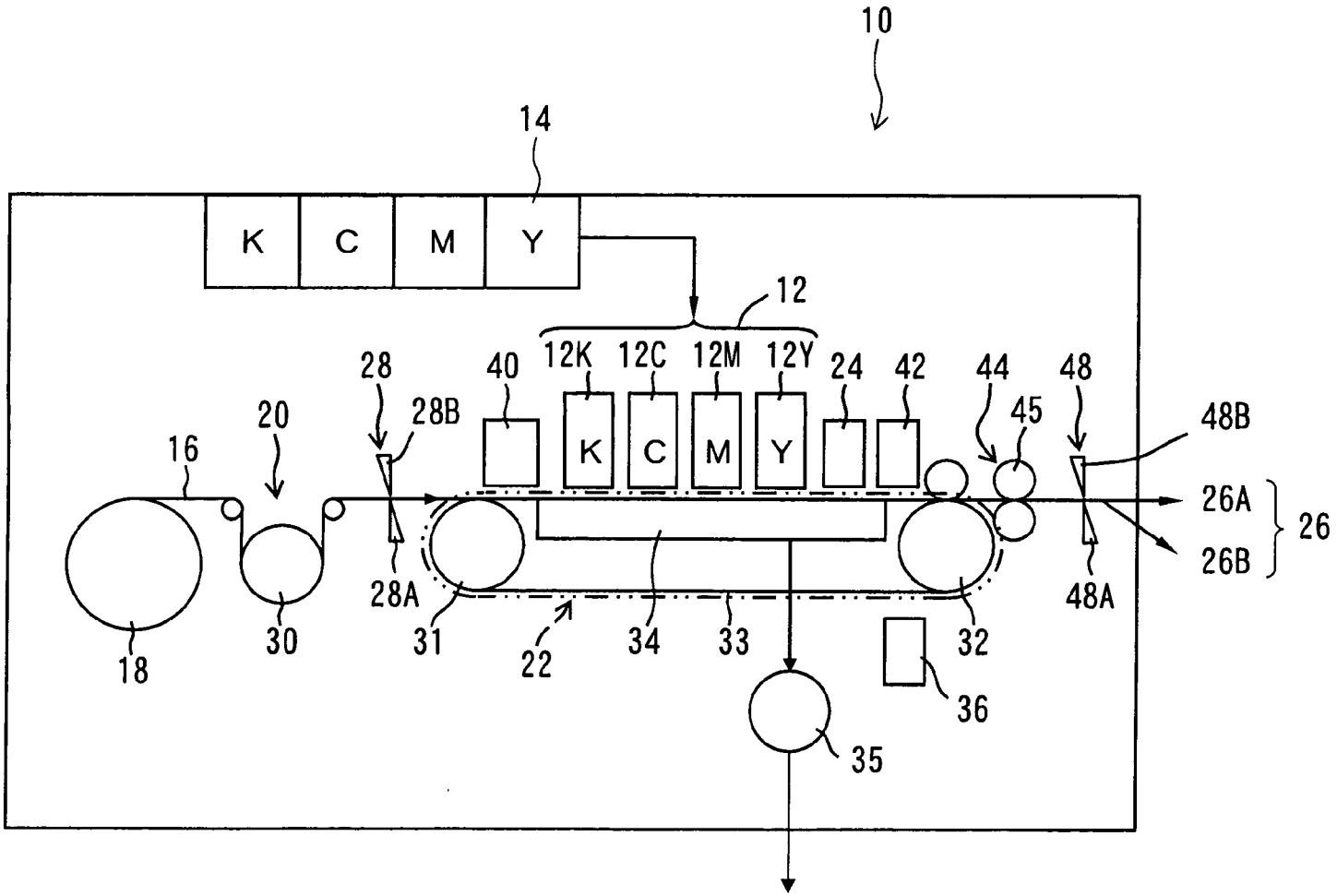
FIG. 1 is a general schematic drawing showing a general view of an inkjet recording apparatus according to an embodiment of the present invention.

Firstly, an inkjet recording apparatus which forms the image forming apparatus according to an embodiment of the present invention is described below. FIG. 1 is a general schematic drawing showing an overall view of the inkjet recording apparatus. As shown in FIG. 1, the inkjet recording apparatus 10 includes: a print unit 12 having a plurality of recording heads 12K, 12C, 12M, and 12Y for ink colors of black (K), cyan (C), magenta (M), and yellow (Y), respectively; an ink storing and loading unit 14 for storing inks of K, C, M and Y to be supplied to the recording heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30, in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle face of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can include a roller nip conveyance mechanism, in which the recording paper 16 is pinched and conveyed with nip rollers, instead of the suction belt conveyance unit 22. However, there is a drawback in the roller nip conveyance mechanism in that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line recording head" in which a line head having a length corresponding to the maximum paper width is arranged in a direction (main scanning direction) that is perpendicular to the paper conveyance direction (sub-scanning direction). The recording heads 12K, 12C, 12M and 12Y forming the print unit 12 are constituted of line heads in which a plurality of ink ejection ports (nozzles) are arranged through a length exceeding at least one edge of the maximum size recording paper 16 intended for use with the inkjet recording apparatus 10.

The recording heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the recording heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (the sub-scanning direction) just once (in other words, by means of a single sub-scan). Higher-speed printing is thereby made possible and productivity can be improved in comparison with a shuttle type head configuration in which a recording head moves reciprocally in a direction (main-scanning direction) that is perpendicular to paper conveyance direction.

Although the configuration with the KCMY four standard colors is described in the present embodiment, combinations of the ink colors and the number of colors are not limited to those. Light inks or dark inks can be added as required. For example, a configuration is possible in which recording heads for ejecting light-colored inks such as light cyan and light magenta are added.

As shown in FIG. 1, the ink storing and loading unit 14 has ink tanks for storing the inks of the colors corresponding to the respective recording heads 12K, 12C, 12M, and 12Y, and the respective tanks are connected to the recording heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording heads 12K, 12C, 12M, and 12Y for the respective colors, and the ejection of each recording head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated, the paper output unit 26A for the target prints is provided with a sorter for collecting prints according to print orders.

Next, the structure of the recording heads 12K, 12C, 12M and 12Y is described below. The recording heads 12K, 12C, 12M and 12Y of the respective ink colors have the same structure, and a reference numeral 50 is hereinafter used to designate a representative example of the recording heads.

Figure 2:
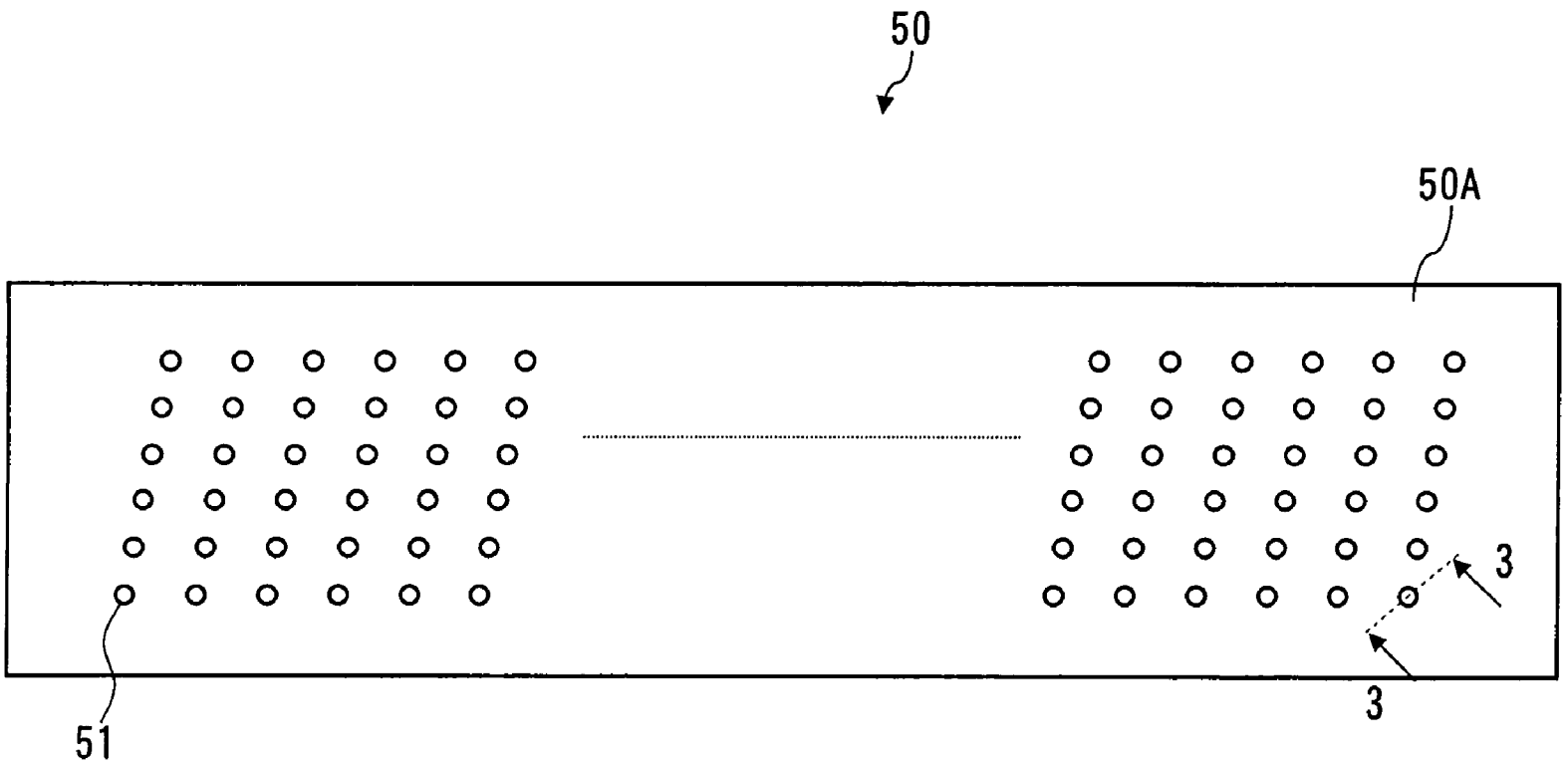
FIG. 2 is a plan diagram showing the nozzle face of a recording head.
Figure 3:
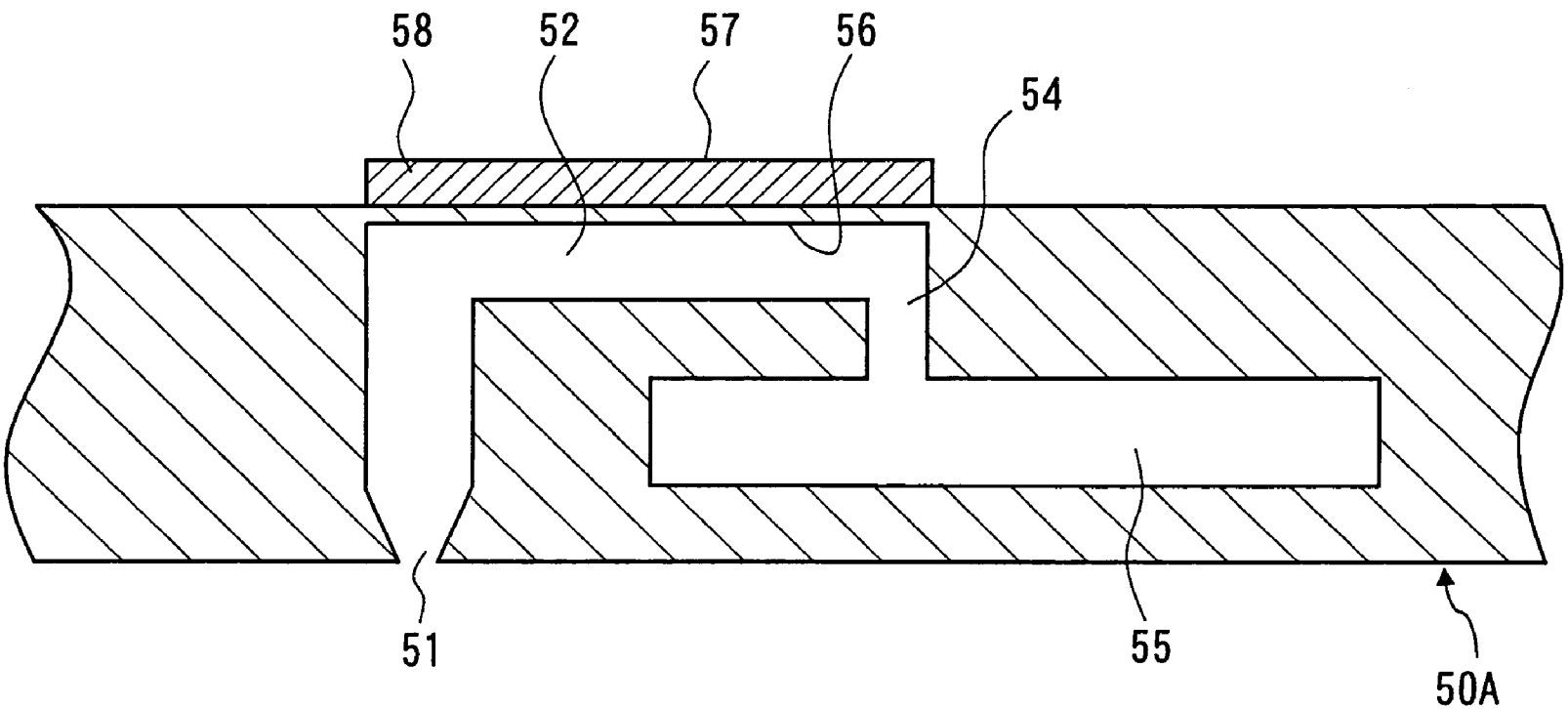
FIG. 3 is a cross-sectional diagram along line 3-3 in FIG. 2.

FIG. 2 is a plan diagram showing a nozzle face (ink ejection surface) 50A of the recording head 50; and FIG. 3 is a cross-sectional diagram along line 3-3 in FIG. 2. As shown in FIG. 2, the recording head 50 has a plurality of nozzles 51 for ejecting ink droplets opened in the nozzle face 50A, and the nozzles 51 are arranged in the lengthwise direction of the head (the lateral direction in FIG. 3) and an oblique direction which is not perpendicular to the lengthwise direction of the head. By means of a two-dimensional (matrix type) nozzle arrangement composition of this kind, it is possible to form dots at a high-density pitch in the lengthwise direction of the head (in other words, in the main scanning direction).

Moreover, as shown in FIG. 3, pressure chambers 52 and piezoelectric elements 58 corresponding to the nozzles 51 are provided in the recording head 50. Each of the pressure chambers 52 has an end connected to the corresponding nozzle 51 and the other end connected to a common flow channel 55 via a supply port 54. The common flow channel 55 is connected to the plurality of pressure chambers 52, and it accumulates ink to be supplied to the pressure chambers 52. Ink is supplied to the common flow channel 55 from the ink storing and loading unit 14 shown in FIG. 1.

Each of the piezoelectric elements 58 is disposed on a diaphragm 56 that constitutes one wall (the upper wall in FIG. 3) of the pressure chamber 52, at a position corresponding to the pressure chamber 52. The piezoelectric element 58 has a structure in which an individual electrode (drive electrode) 57 is disposed on a thin film-shaped piezoelectric body. The diaphragm 56 is made of a conductive member of stainless steel, or the like, and it also serves as a common electrode for the piezoelectric elements 58.

By adopting a composition of this kind, when a drive voltage is applied to the piezoelectric element 58, the ink in the pressure chamber 52 is pressurized due to the deformation of the piezoelectric element 58, and an ink droplet is ejected from the nozzle 51 connected to the pressure chamber 52.

Figure 4:
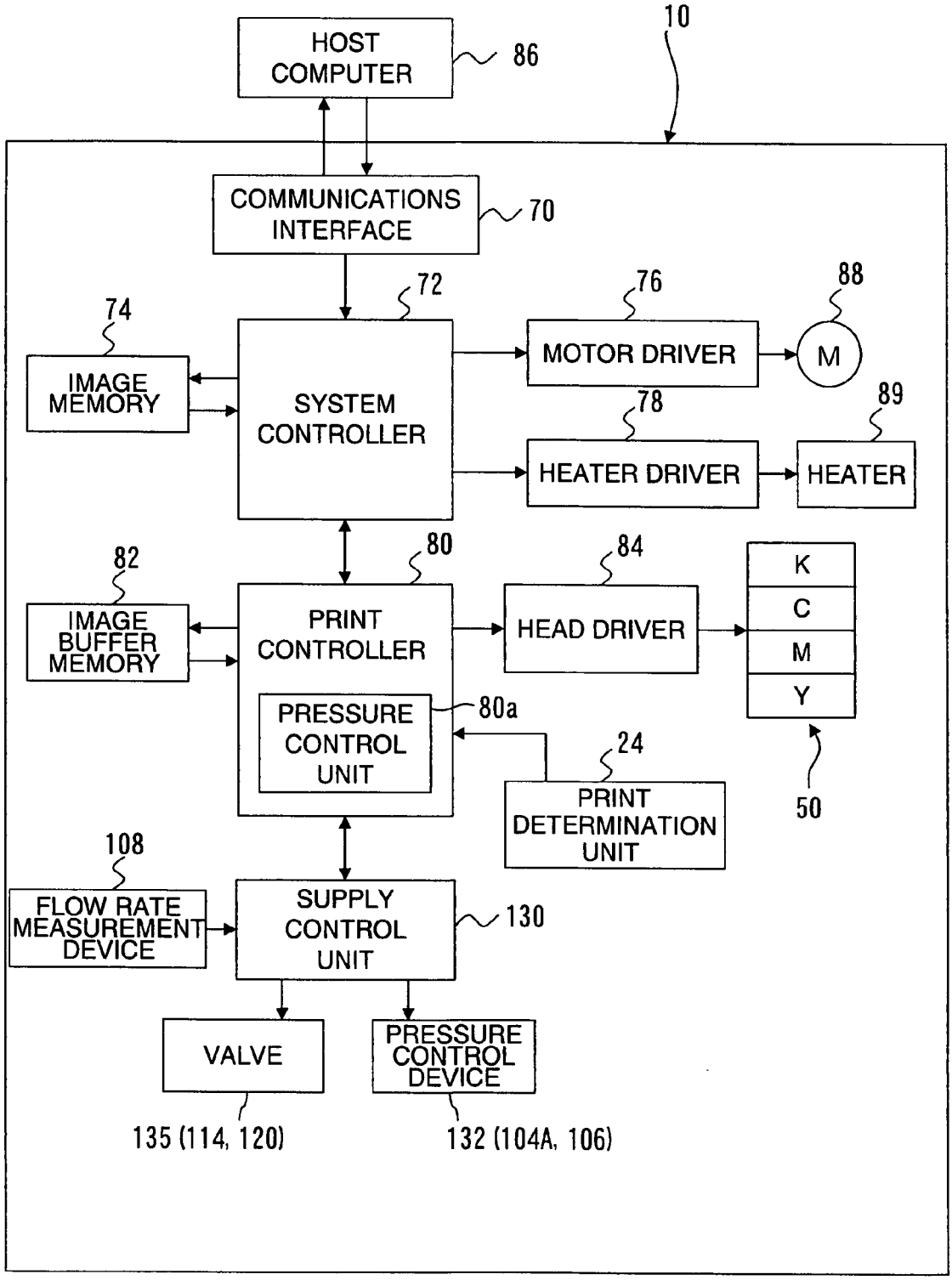
FIG. 4 is a principal block diagram showing a control system of the inkjet recording apparatus.

FIG. 4 is a principal block diagram showing the control system of the inkjet recording apparatus 10. The inkjet recording apparatus 10 includes a communications interface 70, a system controller 72, an image memory 74, a motor driver 76, a heater driver 78, a print controller 80, an image buffer memory 82, a head driver 84, a supply control unit 130, and the like.

The communications interface 70 is an interface unit for receiving image data transmitted by a host computer 86. A serial interface or a parallel interface may be used for the communications interface 70. It is also possible to install a buffer memory (not illustrated) for achieving high-speed communications.

Image data sent from a host computer 86 is read into the inkjet recording apparatus 10 via the communications interface 70, and it is stored temporarily in the image memory 74. The image memory 74 is a storage device for temporarily storing an image input via the communications interface 70, and data is written to and read from the image memory 74 via the system controller 72. The image memory 74 is not limited to a memory composed of a semiconductor element, and a magnetic medium, such as a hard disk, or the like, may also be used.

The system controller 72 is a control unit for controlling the various sections, such as the communications interface 70, the image memory 74, the motor driver 76, the heater driver 78, and the like. The system controller 72 is constituted of a central processing unit (CPU) and peripheral circuits thereof, and the like, and in addition to controlling communications with the host computer 86 and controlling reading and writing from and to the image memory 74, and the like, it also generates control signals for controlling the motor 88 of the conveyance system and the heater 89.

The motor driver 76 is a driver (drive circuit) which drives the motor 88 in accordance with instructions from the system controller 72. The heater driver 78 drives the heater 89 of the post-drying unit 42 and other sections in accordance with commands from the system controller 72.

The print controller 80 is a control unit having a signal processing function for performing various treatment processes, corrections, and the like, in accordance with the control implemented by the system controller 72, in order to generate signals for controlling printing from the image data in the image memory 74. The print controller 80 supplies the print control signal (dot data) thus generated to the head driver 84. Required signal processing is carried out in the print controller 80, and the ejection amount and the ejection timing of the ink droplets from the recording head 50 are controlled via the head driver 84, on the basis of the image data. By this means, desired dot sizes and dot positions can be achieved.

A supply control unit 130 controls a pressure control device 132 (a first pressure control device 104A and the second pressure control device 106) and the valve unit 135 (valves 114 and 120) on the basis of the control implemented by the print controller 80 and in accordance with the flow rate measured by a flow rate measurement device 108. The concrete control method is described in detail later.

An image buffer memory 82 is provided with the print controller 80, and image data, parameters, and other data are temporarily stored in the image buffer memory 82 when image data is processed in the print controller 80. FIG. 4 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

The head driver 84 generates drive signals for driving the piezoelectric elements 58 of the recording heads 50 of the respective colors (see FIG. 3) on the basis of the dot data supplied from the print controller 80, and it supplies the drive signals thus generated to the piezoelectric elements 58. A feedback control system for maintaining constant drive conditions for the recording heads 50 may be included in the head driver 84.

As shown in FIG. 1, the print determination unit 24 is a block including a line sensor, which reads in the image printed onto the recording medium 16, performs various signal processing operations, and the like, and determines the print situation (presence/absence of ejection, variation in droplet ejection, and the like), and these determination results are supplied to the print controller 80.

Furthermore, according to requirements, the print controller 80 makes various corrections with respect to the recording head 50 on the basis of information obtained from the print determination unit 24.

Figure 5:
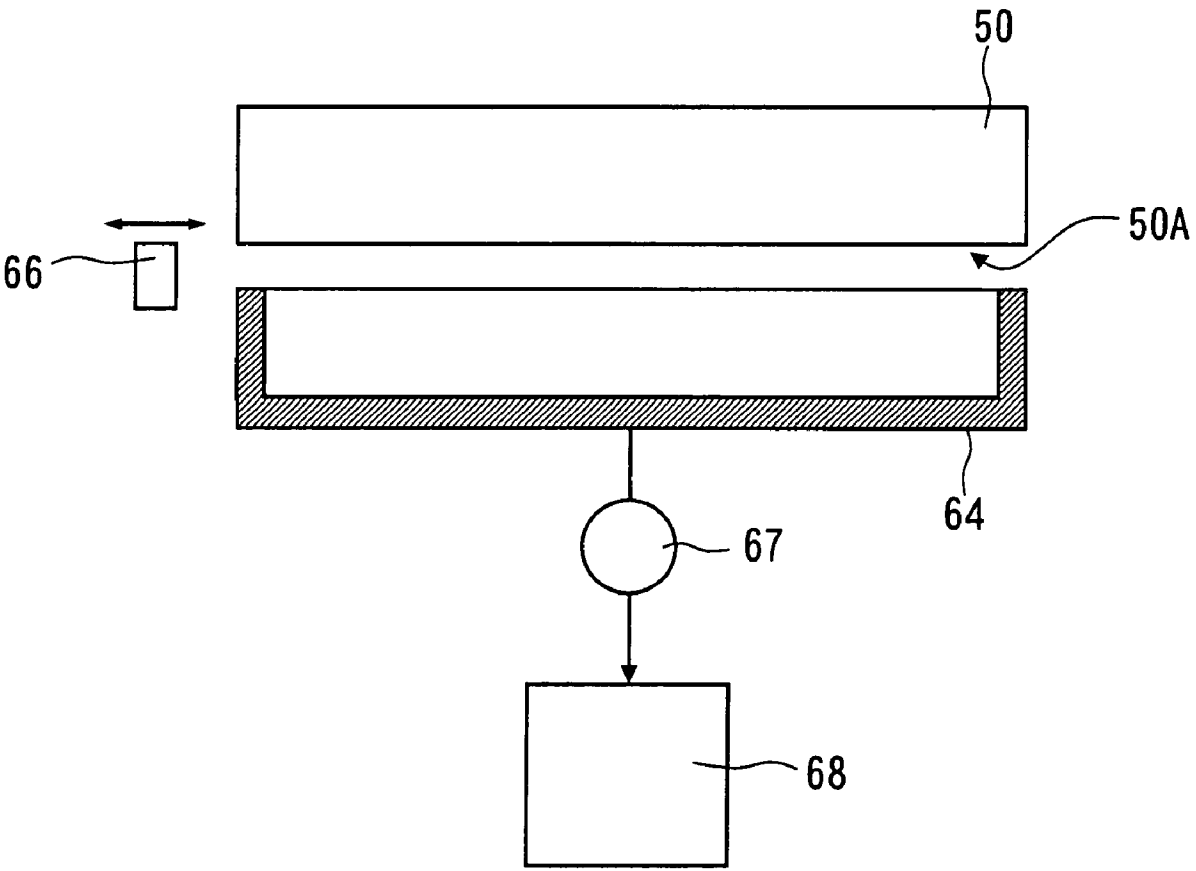
FIG. 5 is a schematic drawing showing the composition of a maintenance system in the inkjet recording apparatus.

FIG. 5 is a schematic diagram showing the composition of a maintenance system in the inkjet recording apparatus 10. As shown in FIG. 5, the inkjet recording apparatus 10 includes a cap 64 as a device to prevent the ink from drying out or to prevent an increase in the ink viscosity in the vicinity of the nozzles, and a cleaning blade 66 as a device to clean the nozzle face 50A of the recording head 50. A maintenance unit including the cap 64 and the cleaning blade 66 can be moved in a relative fashion with respect to the recording head 50 by a movement mechanism (not shown), and is moved from a predetermined holding position to a maintenance position under the recording head 50 as required.

The cap 64 is displaced upwards and downwards in a relative fashion with respect to the recording head 50 by an elevator mechanism (not shown). When the power of the inkjet recording apparatus 10 is switched OFF or when in a print standby state, the cap 64 is raised to a predetermined raised position so as to come into close contact with the recording head 50, and the nozzle face 50A of the recording head 50 is thereby covered with the cap 64.

The cleaning blade 66 is composed of rubber or another elastic member, and can slide on the nozzle face 50A of the recording head 50 by means of a blade movement mechanism (not shown). If ink droplets or foreign matter are adhering to the nozzle face 50A, then a so-called wiping operation is carried out in which the cleaning blade 66 wipes away the ink droplets, and the like, by wiping over the nozzle face 50A.

During printing or during standby, if the use frequency of a particular nozzle has declined and the ink viscosity in the vicinity of the nozzle 51 has increased, then a preliminary ejection is performed onto the cap 64, in order to remove the degraded ink.

Also, when bubbles have become intermixed into the ink inside the recording head 50 (inside the pressure chambers 52), the cap 64 is placed on the recording head 50, ink (ink in which bubbles have become intermixed) inside the recording head 50 is removed by suction with a suction pump 67, and the ink removed by suction is sent to a recovery tank 68. This suction operation is also carried out in order to remove degraded ink having increased viscosity (hardened ink), when ink is loaded into the head for the first time, and when the recording head 50 starts to be used after having been out of use for a long period of time.

In other words, when a state in which ink is not ejected from the recording head 50 continues for a certain amount of time or longer, the ink solvent in the vicinity of the nozzles 51 evaporates and the ink viscosity increases. In such a state, ink can no longer be ejected from the nozzles 51 even if the actuators (piezoelectric elements 58) for driving ejection are operated. Therefore, before reaching such a state (in a viscosity range that allows ejection by the operation of the piezoelectric elements 58), the piezoelectric elements 58 are operated and the ink is ejected toward an ink receptacle, and a preliminary ejection is performed which causes the ink in the vicinity of the nozzles that has increased in viscosity, to be ejected. Furthermore, after cleaning away soiling on the surface of the nozzle face 50A by means of a wiper, such as a cleaning blade 66, provided as a cleaning device on the nozzle face 50A, a preliminary ejection is also carried out in order to prevent infiltration of foreign matter into the nozzles 51 because of the rubbing action (wiping operation) of the wiper. The preliminary ejection is also referred to as "dummy ejection", "purge", "liquid ejection", and so on.

When bubbles have become intermixed in the nozzles 51 or the pressure chambers 52, or when the ink viscosity in the vicinity of the nozzles has increased beyond a certain level, ink can no longer be ejected by means of the preliminary ejection, and hence a suctioning action is carried out as follows.

More specifically, when bubbles have become intermixed in the ink inside a nozzle 51 or a pressure chamber 52, or when the ink viscosity in the vicinity of a nozzle has increased to a certain level or more, ink can no longer be ejected from the nozzle 51 even if the piezoelectric element 58 is operated. In these cases, a cap 64 serving as a suctioning device to remove the ink inside the pressure chamber 52 by suction with a pump, or the like, is made contact with the nozzle face 50A of the recording head 50, and the ink in which bubbles have become intermixed or the ink whose viscosity has increased is removed by suction.

Figure 6:
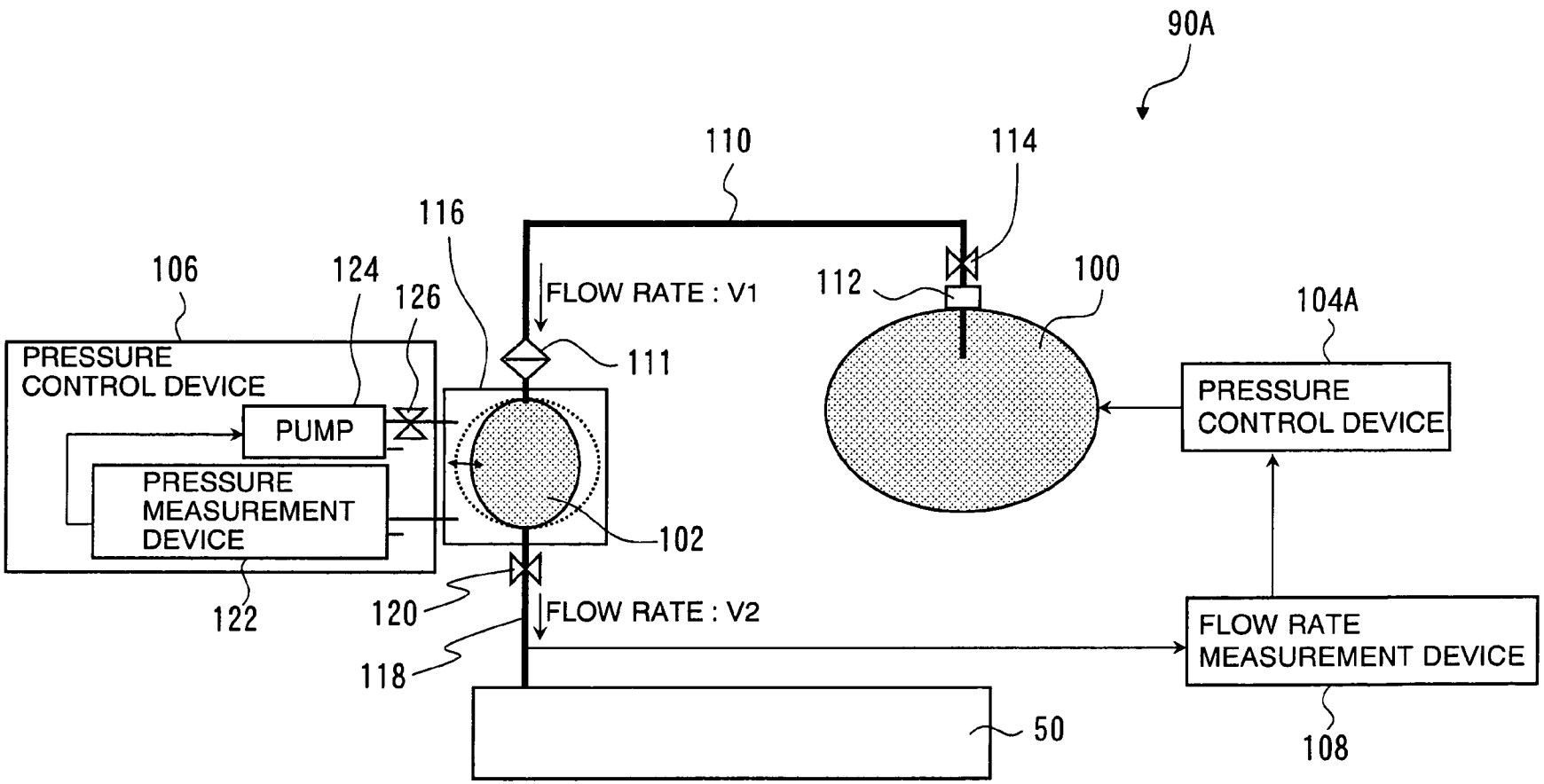
FIG. 6 is a schematic drawing showing the composition of a liquid supply apparatus according to a first embodiment of the present invention.

Next, the composition of the liquid supply apparatus according to an embodiment of the present invention is described below. FIG. 6 is a schematic drawing showing the composition of a liquid supply apparatus 90A according to a first embodiment of the present invention. As shown in FIG. 6, the liquid supply apparatus 90A principally includes a main tank 100, a sub tank 102, a first pressure control device 104A, a second pressure control device 106 and a flow rate measurement device 108. The main tank 100 and the sub tank 102 are connected via a first flow channel 110, and the sub tank 102 and the recording head 50 are connected via a second flow channel 118. Moreover, valves 114 and 120 are provided in the first flow channel 110 and the second flow channel 118, respectively. Below, the flow rate in the first flow channel 110 is taken as V1, and the flow rate in the second flow channel 118 is taken as V2.

The main tank 100 has a large capacity and stores ink to be supplied to the recording head 50 via the sub tank 102, and it is equivalent to the ink storing and loading unit 14 shown in FIG. 1. The main tank 100 is located at substantially the same height (in substantially same position in terms of a vertical direction) as the sub tank 102. The main tank 100 supplies ink to the sub tank 102 by means of an external pressure that is applied to the main tank 100 or air that is injected into the main tank 100. In the case of deaerated ink, then it is desirable that the main tank 100 be sealed, and on the other hand, the main tank 100 may be opened to the atmosphere in the case of non-deaerated ink.

The main tank 100 is provided with a connection member 112 through which the main tank 100 is detachably attached to the first flow channel 110, and a cartridge system is employed in which the main tank is replaced with a new one when the remaining amount of ink in the main tank has become low. When seeking to change the type of ink in accordance with applications, then this cartridge-based system is suitable. In this case, desirably, information relating to the ink type is identified by means of a bar code, or the like, and the ejection of the ink is controlled in accordance with the ink type. Moreover, instead of the cartridge system, it is also possible to adopt a method in which ink is replenished via a replenishment port.

The sub tank 102 has a small capacity and temporarily stores ink that has been supplied from the main tank 100 and is to be supplied to the recording head 50. The sub tank 102 according to the present embodiment is at least partially constituted by a bag-shaped flexible (deformable) member (in other words, a member which is not connected to the atmosphere and the volume of which can change in accordance with the volume of ink), and the sub tank 102 is disposed inside a rigid (inelastic, undeformable) hermetically sealed container 116. The internal space of the sealed container 116 (the space defined by the sealed container 116 and the sub tank 102; excluding the sub tank 102) is filled with air.

The sub tank 102 is disposed vertically above the recording head 50 and is connected with the common flow channel 55 (shown in FIG. 3) in the recording head 50 by means of the second flow channel 118. In the present embodiment, the sub tank 102 is desirably disposed in the vicinity of the recording head 50 vertically above the recording head 50, or the sub tank 102 may be united with the recording head 50. The range, "vicinity of the recording head 50 vertically above the recording head 50", indicates a rage from more than 0 mm through not more than 100 mm, for example. The closer the sub tank 102 to the recording head 50, the more desirable. This is because the shorter the length of the second flow channel 118 (the flow channel length), the less the pressure loss in the second flow channel 118.

A filter 111 is provided in the first flow channel 110 in order to remove foreign matter and air bubbles. Desirably, the filter mesh size is the same as the nozzle diameter, or smaller than the nozzle diameter (generally, about 20 μm).

The flow rate measurement device 108 is a device which measures the flow rate V2 in the second flow channel 118, namely, the ink supply volume from the sub tank 102 to the recording head 50. The measurement results (flow rate V2) obtained by the flow rate measurement device 108 are reported to the first pressure control device 104A. For the flow rate measurement device 108, it is possible to use generally known systems including, for example: an impeller system in which a propeller is provided in the second flow channel 118 and the rotation number of the propeller is measured; a floater system in which a floating element is provided and the flow rate is measured on the basis of the amount of rise or fall in the floating element; and a differential pressure system in which the pressure differential between two points is measured and then the flow rate is calculated on the basis of Bernoulli's theorem. However, since the pressure loss is increased in these systems, then it is desirable to calculate the sum total of the ejection volume on the basis of the dot data determined from the input image data, and to estimate the ejection volume per unit time, namely, the flow rate V2 accordingly.

The first pressure control device 104A is a device which controls the internal pressure of the main tank 100 by changing the pressure applied to the main tank 100 in accordance with the measurement results (flow rate V2) obtained by the flow rate measurement device 108. The first pressure control device 104 may use various methods including, for example, a method where the main tank 100 is pushed and pulled by an external pressure, a method where the injection volume of air into the main tank is increased or reduced, and a method where the main tank 100 is moved upward or downward in the vertical direction.

In the case of deaerated ink, a method which pushes and pulls the main tank 100 by means of an external pressure is desirable, and in the case of non-deaerated ink, a method which increases or decreases the injection volume of air into the main tank 100 is desirable.

Figure 7:
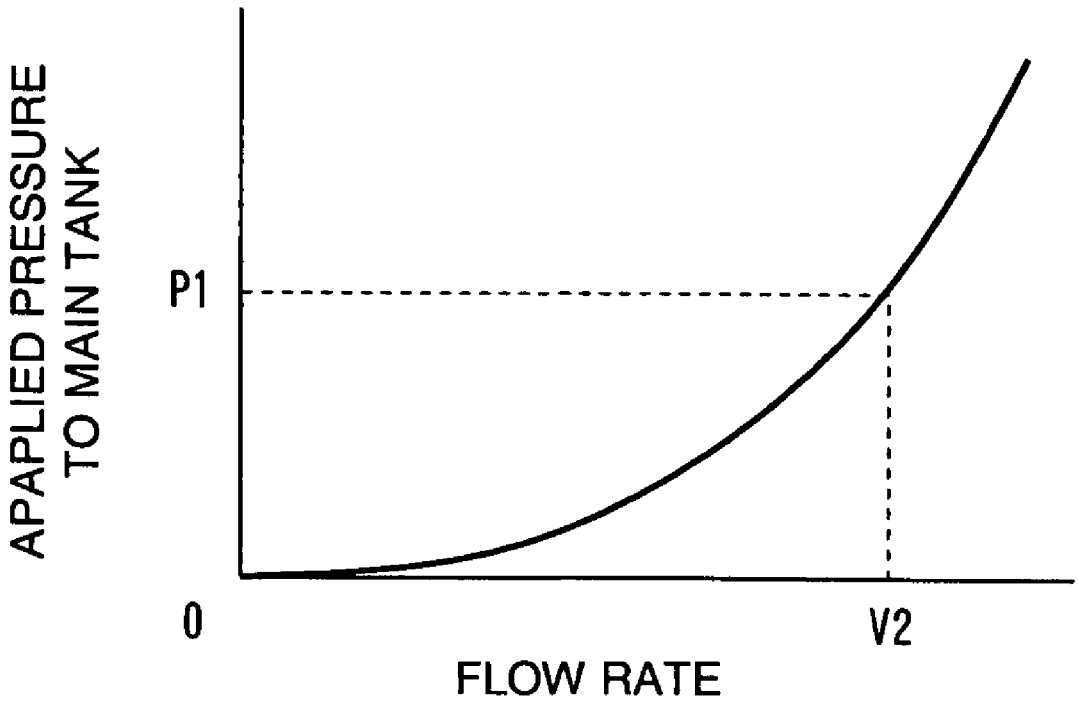
FIG. 7 is a diagram showing an example of the relationship between the flow rate in the second flow channel and the pressure to be applied to the main tank.

The relationship between the flow rate V2 and the pressure to be applied to the main tank 100 may be determined statistically on the basis of experimentation, or it may be determined on the basis of design values. FIG. 7 is a diagram showing an example of the relationship between the flow rate V2 and the pressure to be applied to the main tank 100. As shown in FIG. 7, it is possible to obtain a single value of the pressure P1 to be applied to the main tank 100, directly from the flow rate V2. As shown in FIG. 7, the greater the flow rate V2, the greater the pressure P1 to be applied to the main tank 100. In other words, if the flow rate V2 increases in accordance with an increase in the amount of ink consumed by the recording head 50, then the pressure to be applied to the main tank 100 by the first pressure control device 104 is also increased, and the ink supply volume (the flow rate V1) from the main tank 100 to the sub tank 102 is increased. Consequently, it is possible to suppress sudden pressure variations inside the sub tank 102.

The second pressure control device 106 is a device which controls the internal pressure of the sub tank 102 to fall within a range which permits stable ejection of the recording head 50. The second pressure control device 106 is constituted principally by a pressure measurement device 122 and a pump 124.

The pressure measurement device 122 is configured to measure the pressure differential ΔP between the internal pressure of the sealed container 116 and the atmospheric pressure. The pump 124 is a pressure adjustment device which adjusts the internal pressure of the sealed container 116. The pump 124 is connected to the interior of the sealed container 116 at an end of the pump 124, via a valve 126, and the pump 124 is also connected to the atmosphere at the other end thereof. In the present embodiment, a rotary pump is used as the pump 124, but the pump is not limited to this and it is also possible to use various other well known types of pumps.

The internal pressure of the sealed container 116 is adjusted by means of the pump 124 on the basis of the measurement results (namely, the pressure differential ΔP) obtained by the pressure measurement device 122. In other words, the internal pressure of the sealed container 116 is adjusted by driving the pump 124 in such a manner that the pressure differential ΔP measured by the pressure measurement device 122 falls within a target range. The internal pressure of the sub tank 102, which is disposed inside the sealed container 116, is thereby controlled to fall within a prescribed range. As a result of this, it is possible to keep the internal pressure (negative pressure) of the recording head 50 to a pressure within a prescribed range, irrespective of the magnitude of the pressure loss in the first flow channel 110, and consequently stable ejection can be achieved in the recording head 50.

In the present embodiment, air is filled into the internal space of the sealed container 116 (apart from the sub tank 102), but the invention is not limited to this, and it is also possible to fill another gas or liquid into this internal space. In other words, the internal space of the sealed container 116 may be filled with any filling material, as long as the filling material allows the internal pressure of the sub tank 102 to be adjusted, indirectly.

Figure 8:
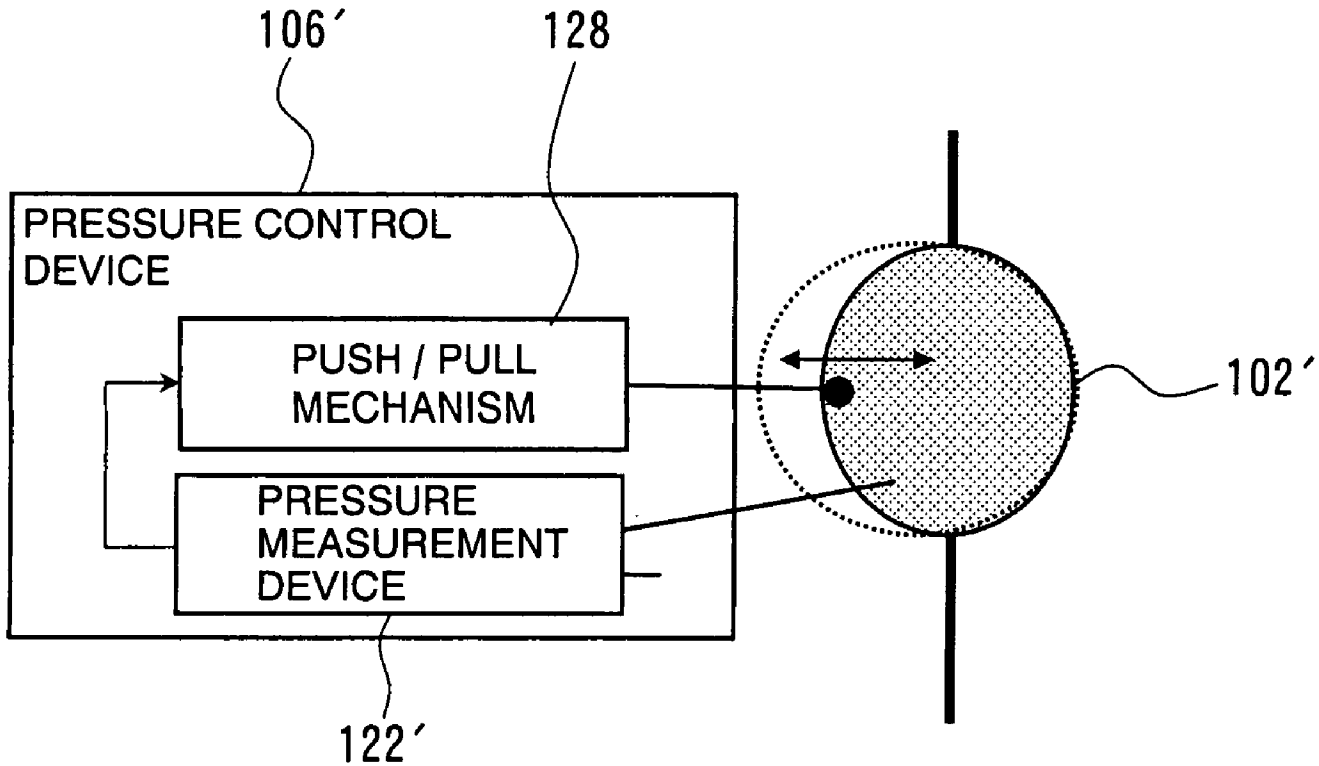
FIGS. 8 and 9 are diagrams showing modifications of the first embodiment.
Figure 9:
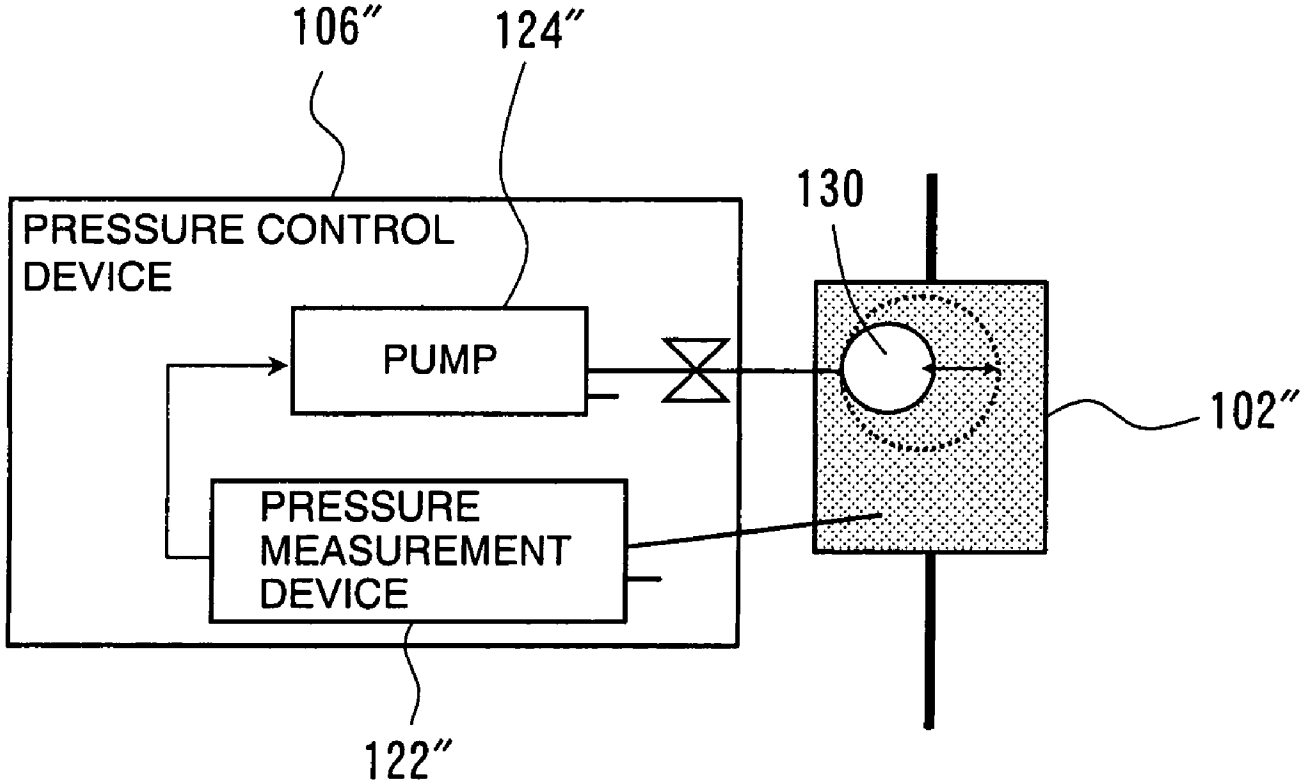

The composition of the sub tank 102 and the second pressure control device 106 is not limited to the one in the present embodiment. FIG. 8 is a diagram showing a first modified composition relative to the present embodiment. As shown in FIG. 8, a composition is possible in which a sub tank 102' is exposed to the atmosphere, and a second pressure control device 106' includes: a pressure measurement device 122' which measures the pressure differential between the internal pressure of the sub tank 102' and the atmospheric pressure; and a pushing and pulling mechanism 128 which pushes and pulls the surface of the sub tank 102' in accordance with the measurement results. In this modified composition, since a pump is not used, then it is possible to adjust the pressure without generating pump vibration. FIG. 9 is a diagram showing a second modified composition relative to the present embodiment. As shown in FIG. 9, it is also possible to adopt a composition in which a flexible bag member 130 is provided in a sub tank 102" which stores ink, and a second pressure control device 106" may include: a pressure measurement device 122" which measures the pressure differential between the internal pressure of the sub tank 102" and the atmospheric pressure; and a pump 124" which adjusts the internal pressure of the flexible bag member 130 in accordance with the measurement results of the pressure measurement device 122". In the second modified composition, it is possible to minimize the surface area of the flexible bag member, hence minimizing the gas permeability. Increase in the amount of dissolved oxygen can thus be prevented, and this is beneficial when using a deaerated ink. In any of the modified compositions described above, beneficial effects similar to those of the present embodiment can be obtained.

Figure 10:
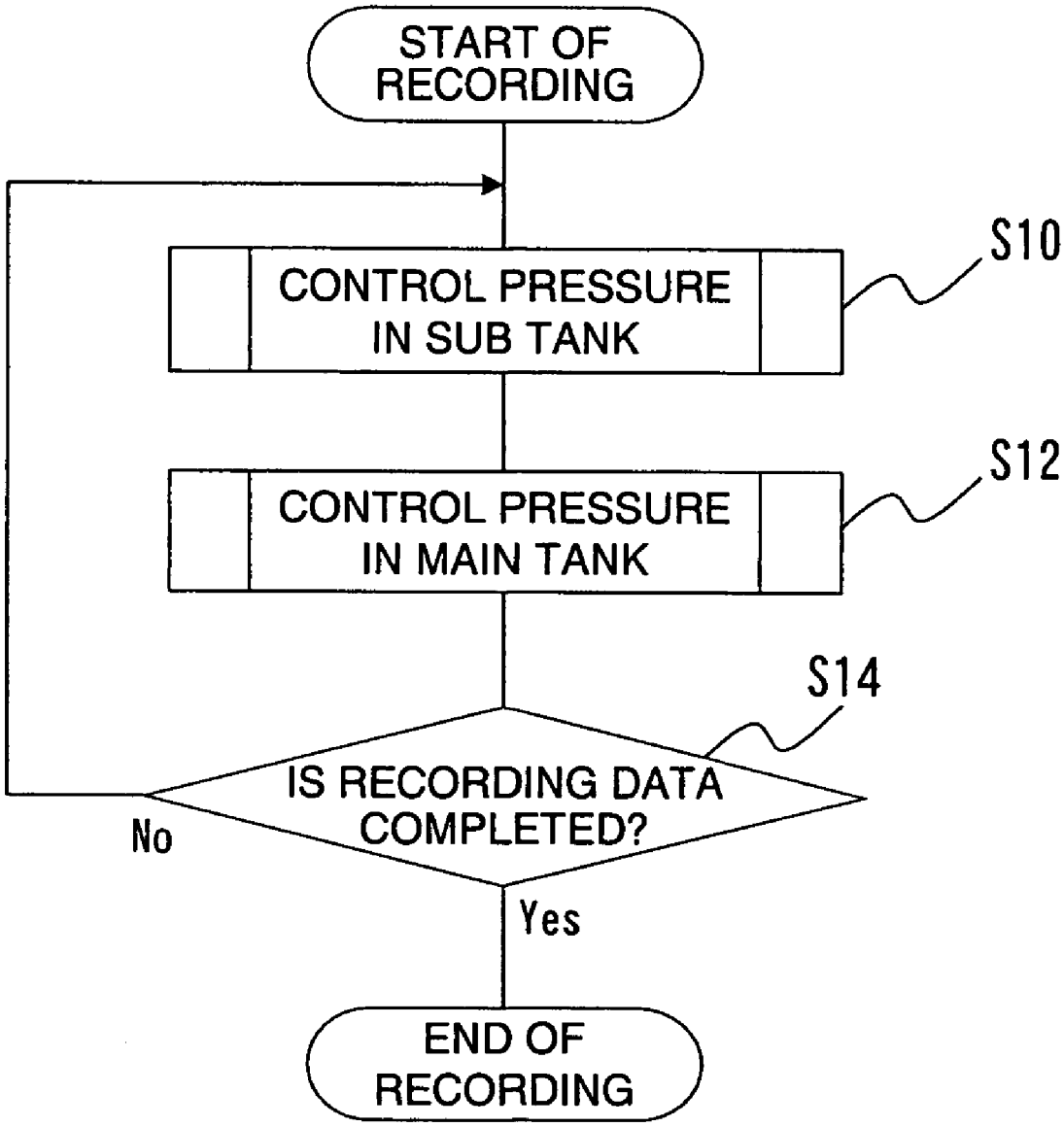
FIG. 10 is a diagram showing the overall sequence of pressure control according to the first embodiment.
Figure 11:
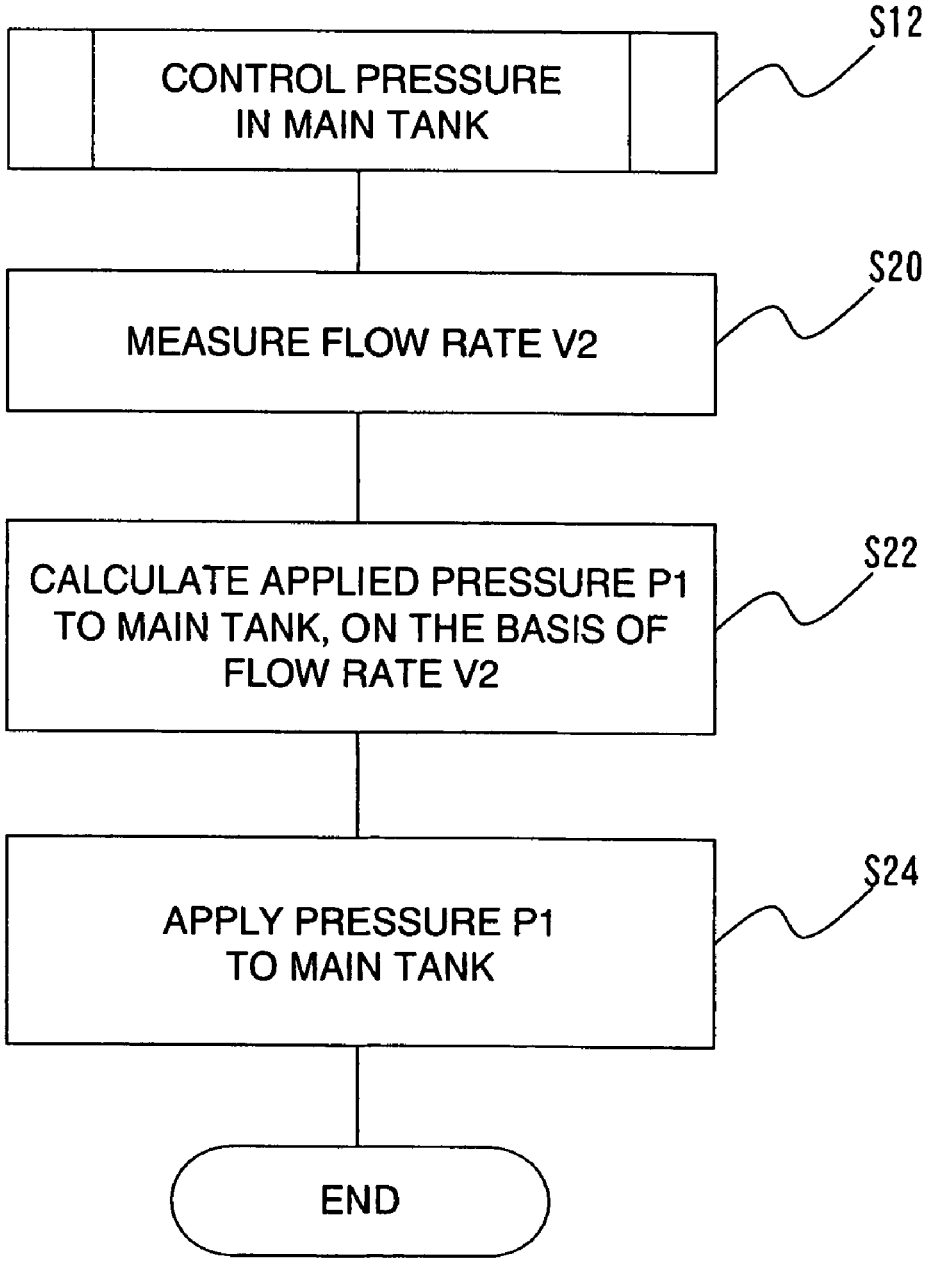
FIG. 11 is a diagram showing the detailed sequence of pressure control for the main tank, according to the first embodiment.
Figure 12:
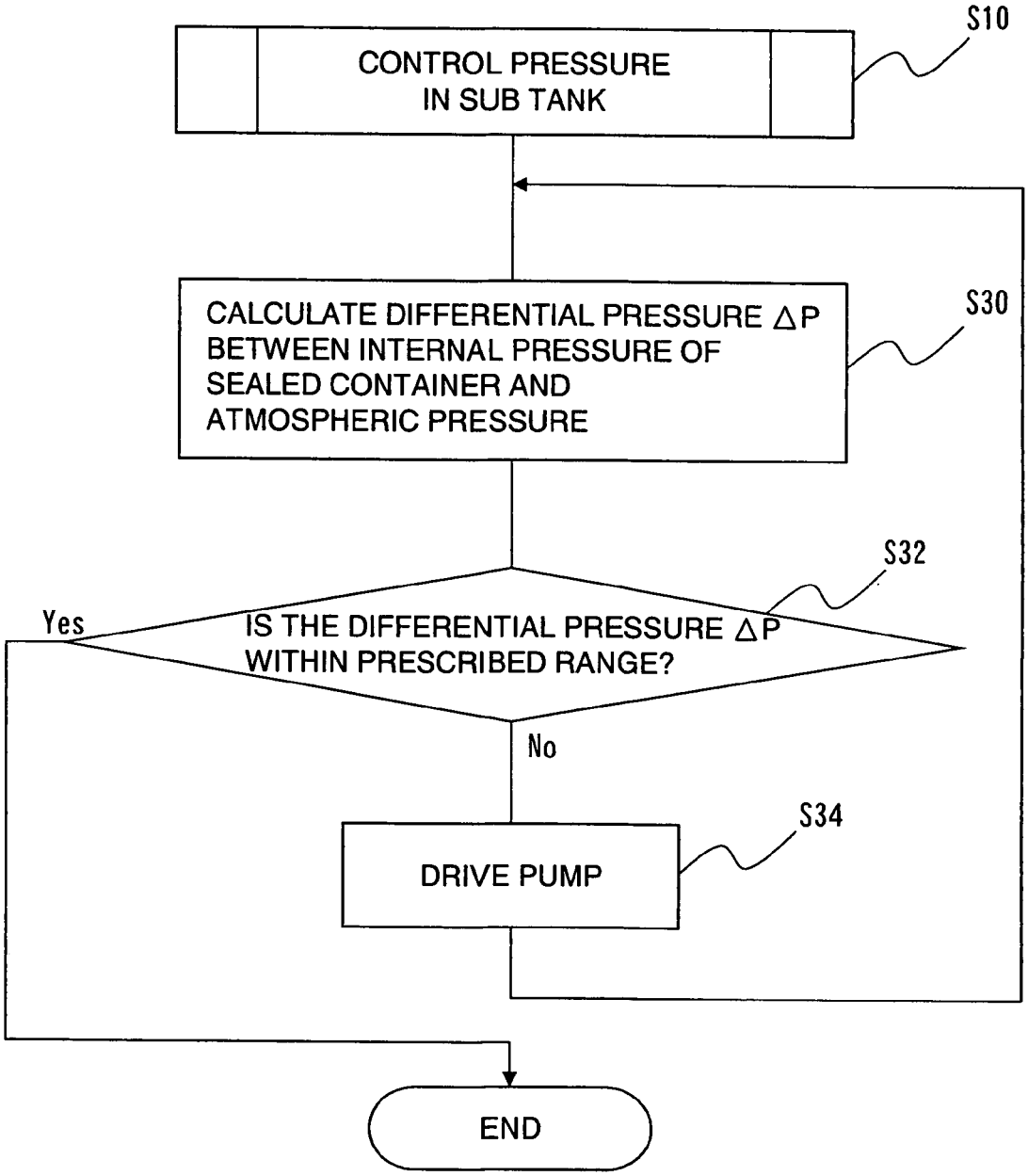
FIG. 12 is a diagram showing the detailed sequence of pressure control for the sub tank, according to the first embodiment.

FIGS. 10 to 12 are flowchart diagrams showing pressure control procedures according to the first embodiment of the present invention. The pressure control procedures are described below with reference to FIGS. 10 to 12.

FIG. 10 shows the overall sequence of pressure control. Firstly, before starting a recording operation by means of the recording head 50, all of the valves 114, 120 and 126 shown in FIG. 6 are opened, and the pressure control devices 104A and 106, and the flow rate measurement device 108 are set to an operation-ready state. Moreover, suitable amounts of ink are stored in the main tank 100 and the sub tank 102, and the internal pressures of the main tank 100 and the sub tank 102 are also set to suitable pressures.

Firstly, when a recording operation is started, the pressure in the sub tank 102 is controlled (step S10). Moreover, the pressure in the main tank 100 is controlled (step S12). The steps S10 and S12 may be carried out in parallel; however, if, for example, a recording operation is started and the pressure control for the main tank 100 is carried out before the pressure control for the sub tank 102, then a delay occurs in the pressure adjustment of the sub tank 102, and the ejection characteristics of the recording head 50 may be changed. Therefore, as shown in FIG. 10, desirably, pressure control is carried out with respect to the sub tank 102, before pressure control for the main tank 100. The recording operation (ejection operation) performed by the recording head 50 is not shown in FIG. 10, but the recording operation is carried out in parallel with these pressure adjustment operations.

Next, it is judged whether or not the recording data has ended (step S14). If the recording data has not ended (No), then the procedure returns to step S10, and pressure control is carried out again for the main tank 100 and the sub tank 102. If, on the other hand, the recording data has ended (Yes), then the recording operation terminates. After the end of the recording operation, the operation of the pressure control devices 104A and 106, and the flow rate measurement device 108, is halted, and all of the valves 114, 120 and 126 shown in FIG. 6 are closed.

FIG. 11 shows a detailed sequence of pressure control for the main tank 100. Firstly, the flow rate measurement device 108 measures the flow rate V2 (step S20). As stated previously, the measurement results (flow rate V2) obtained by the flow rate measurement device 108 are reported to the first pressure control device 104A. Subsequently, the first pressure control device 104A calculates the pressure P1 to be applied to the main tank 100, on the basis of the flow rate V2 (step S22), and the pressure P1 is then applied to the main tank 100 (step S24). Thereupon, the pressure control for the main tank 100 terminates.

FIG. 12 shows a detailed sequence of pressure control for the sub tank 102. Firstly, the pressure differential ΔP between the internal pressure of the sealed container 116 and the atmospheric pressure is measured by the pressure measurement device 122 (step S30). Next, it is judged whether or not the pressure differential ΔP measured in the step S30, is within a prescribed range (step S32). If the pressure differential ΔP lies outside the prescribed range (No), then the pump 124 is driven (step S34), the procedure returns to the step S30, and the steps S30 and S32 are carried out again. On the other hand, if the pressure differential ΔP lies within the prescribed range (Yes), then the pressure control process for the sub tank 102 terminates.

According to the first embodiment, by means of the first pressure control device 104A, it is possible to suppress sudden pressure variations in the sub tank 102 by changing the amount of ink supplied from the main tank 100 to the sub tank 102 in accordance with increase or decrease in the amount of ink consumed by the recording head 50. Moreover, by means of the second pressure control device 106, it is possible to keep the internal pressure (negative pressure) of the recording head 50 within a prescribed range, irrespective of the magnitude of pressure loss in the first flow channel 110. Consequently, it is possible to supply ink to the recording head 50 in a stable fashion, even during a recording operation, and hence stable ejection from the recording head can be achieved.

Second Embodiment

Next, a second embodiment of the present invention is described. Below, the description of the parts of the second embodiment which are common to those of the first embodiment described above is omitted, and the explanation focuses on the characteristic features of the present embodiment.

Figure 13:
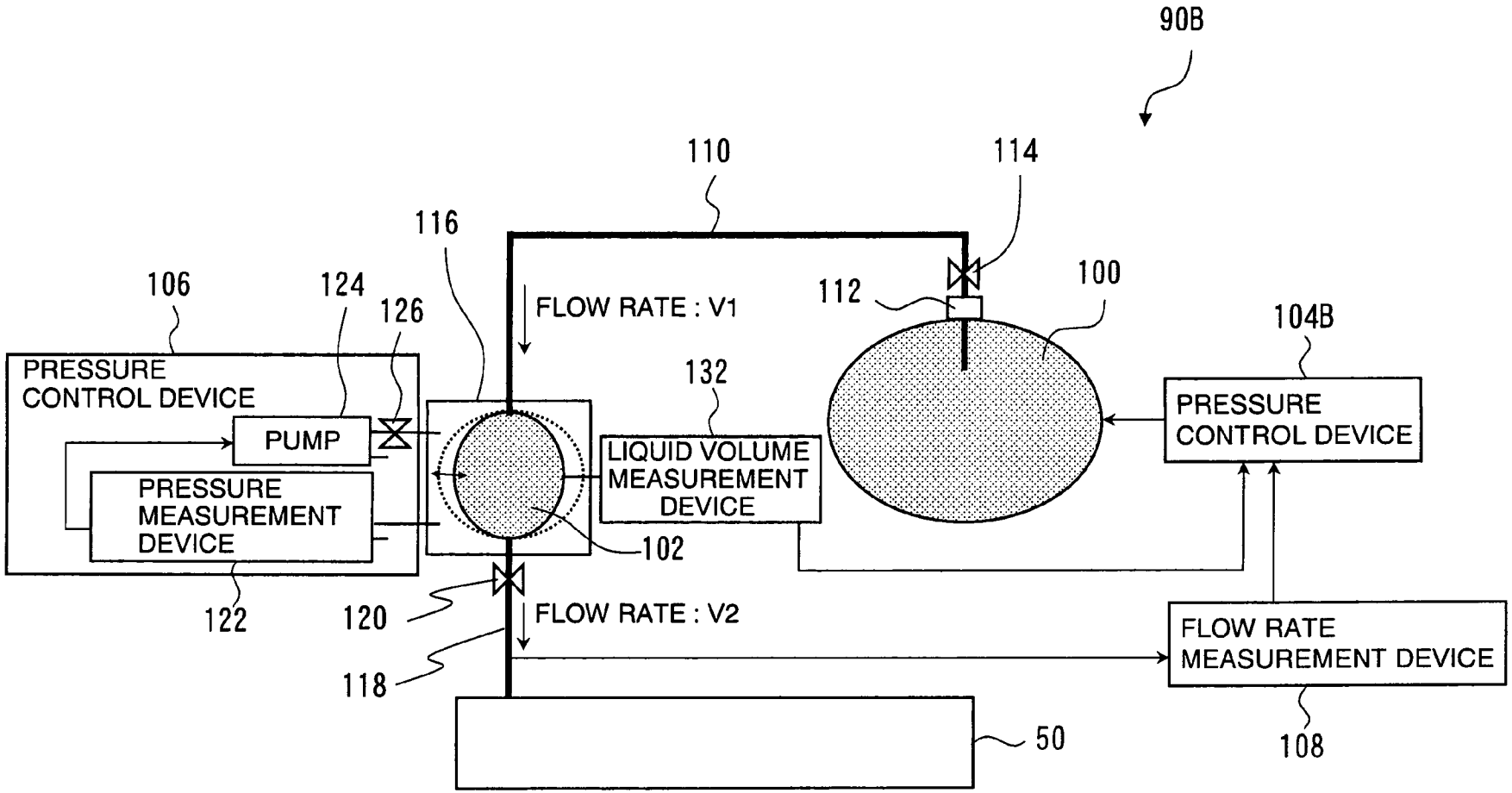
FIG. 13 is a schematic drawing showing the composition of a liquid supply apparatus according to a second embodiment of the present invention.

FIG. 13 is a schematic drawing showing the composition of a liquid supply apparatus 90B according to the second embodiment of the present invention. The liquid supply apparatus 90B according to the second embodiment is different from the liquid supply apparatus 90A according to the first embodiment (shown in FIG. 6), in that the liquid supply apparatus 90B includes a liquid volume measurement device 132, as shown in FIG. 13.

The liquid volume measurement device 132 is a device which measures the amount of ink (liquid volume), S, in the sub tank 102. The measurement results (liquid volume S) obtained by the liquid volume measurement device 132 are reported to a first pressure control device 104B. The liquid volume measurement device 132 may be based, for example, on the amount of transmitted laser light, the displacement of the flexible container as measured by a laser, a distortion gauge, or the like.

The first pressure control device 104B according to the present embodiment uses the measurement results of the liquid volume measurement device 132, as well as the measurement results of the flow rate measurement device 108, to control the internal pressure of the main tank 100. The control method is described below with reference to FIG. 14.

Figure 14:
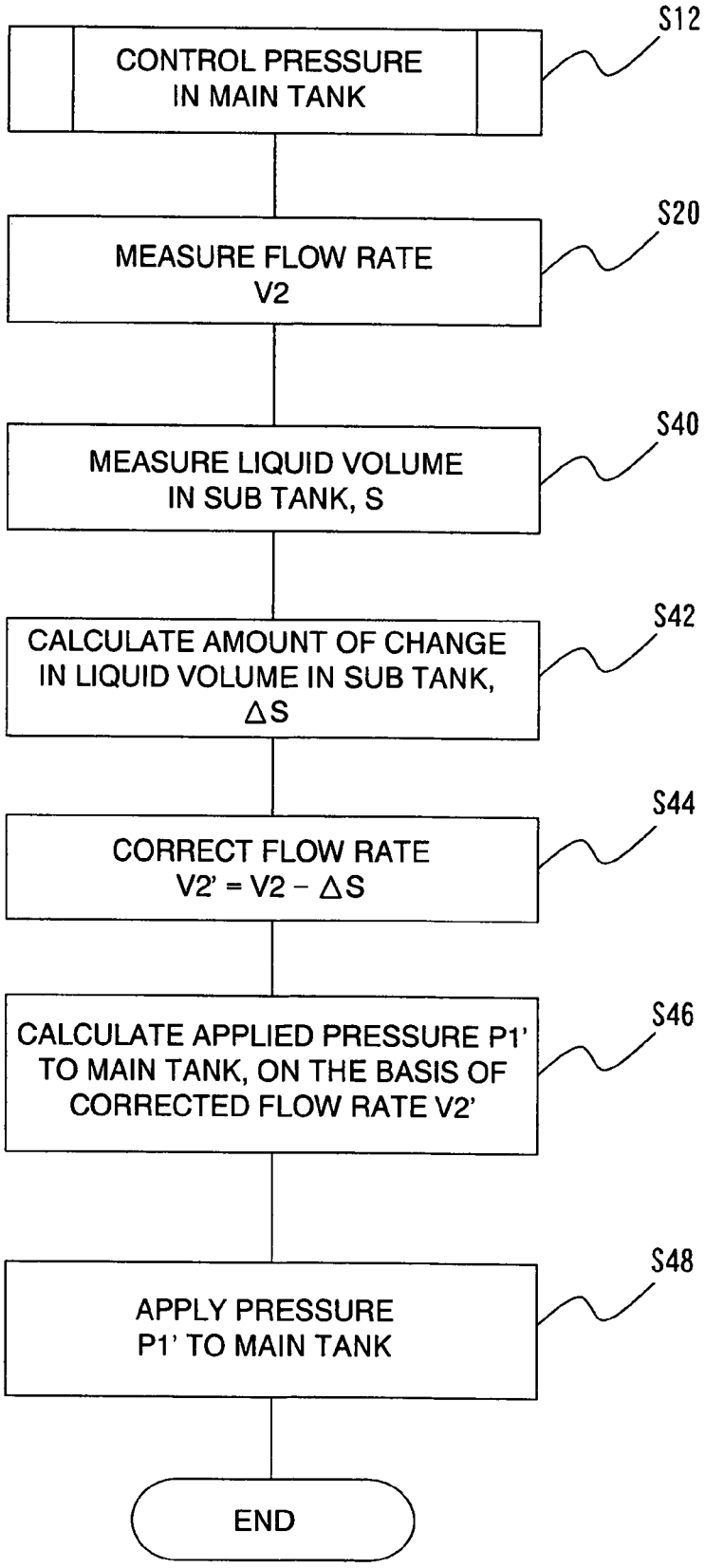
FIG. 14 is a diagram showing the detailed sequence of pressure control for the main tank, according to the second embodiment.

FIG. 14 is a diagram showing the detailed sequence of pressure control for the main tank 100 according to the second embodiment. In FIG. 14, processing steps which are common to those of the first embodiment described above (see FIG. 11) are labeled with the same reference numerals and further description thereof is omitted here.

Firstly, after measuring the flow rate V2 (step S20) in the same manner as the first embodiment, the liquid volume S in the sub tank 102 is measured by the liquid volume measurement device 132 (step S40). The measurement results (liquid volume S) obtained by the liquid volume measurement device 132 are reported to the first pressure control device 104B. The sequence in which the flow rate V2 and the liquid volume S of the sub tank 102 are measured is not limited to that described in the present embodiment, and the flow rate V2 and the liquid volume S may be measured in the reverse sequence, or simultaneously. Since the first pressure control device 104B determines the pressure to be applied to the main tank 100 on the basis of these measurement results, then it is desirable that these values be measured in a substantially simultaneous fashion.

Next, the first pressure control device 104B calculates the amount ΔS of change per unit time in the liquid volume in the sub tank 102, from the measurement results obtained by the liquid volume measurement device 132 (step S42). For example, it is possible to calculate the amount of change in the liquid volume, ΔS, by: storing in a storage device (not shown) the measurement results from the liquid volume measurement device 132 through a plurality of cycles; and then reading out the contents stored in the storage device.

Thereupon, the first pressure control device 104B corrects the flow rate V2 (step S44). The flow rate V2 is corrected by using the amount of change in the liquid volume, ΔS, calculated at step S42. More specifically, the value obtained by subtracting the amount ΔS of change in the liquid volume, from the flow rate V2, forms the flow rate after correction (hereinafter, called the corrected flow rate) V2', and hence the following relationship is established: $V2'=V2-\Delta S$.

Subsequently, the first pressure control device 104B determines the pressure P1' to be applied to the main tank 102, on the basis of the corrected flow rate V2' (step S46), and the pressure P1' is applied to the main tank 100 (step S48). Thereupon, the pressure control process for the main tank 100 terminates.

Figure 15:
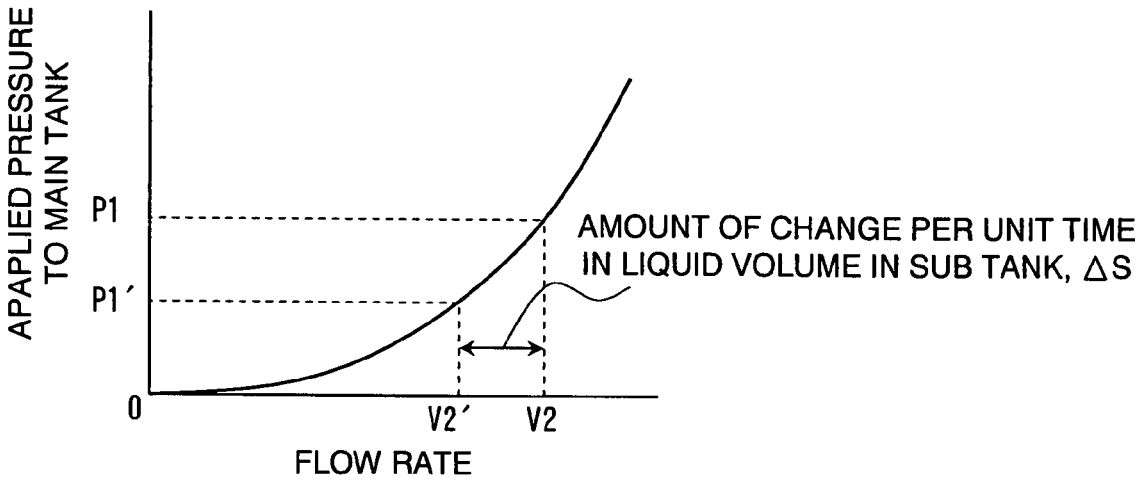
FIG. 15 is a diagram showing an example of the relationship between the flow rate in the second flow channel and the pressure to be applied to the main tank.

FIG. 15 is a diagram showing one example of the relationship between the flow rate in the second flow channel 118 and the pressure to be applied to the main tank 100. If the amount of ink consumed by the recording head 50 decreases, due to ejection failures or the like, and hence the liquid volume S in the sub tank 102 increases (in other words, $\Delta S>0$), then the corrected flow rate V2' is smaller than the flow rate V2 before correction, as shown in FIG. 15. Therefore, the pressure P1' to be applied to the main tank 100, which is calculated on the basis of the corrected flow rate V2', is smaller than the applied pressure P1 calculated on the basis of the flow rate V2 before correction. Hence, the ink supply volume (flow rate V1) from the main tank 100 to the sub tank 102 decreases in comparison with the volume before correction, and therefore it is possible to keep the liquid volume S in the sub tank 102 to be within a uniform range of variation. Furthermore, a similar mechanism applies in cases where the liquid volume S of the sub tank 102 is decreased (in other words, where $\Delta S<0$).

In the present embodiment, desirably, the variation of the liquid volume S in the sub tank 102 falls within a range of 1% through 3% with respect to a reference volume. However, since the variation depends on the type of ink, the structure of the liquid supply apparatus 90B and the recording head 50, then it is necessary to set a range of variation appropriately on the basis of these factors.

In the second embodiment, it is possible to keep the liquid volume S in the sub tank 102 to fall within a prescribed range, even if an error occurs in the flow rate V2 measured by the flow rate measurement device 108 because of various factors such as change in the ink viscosity, measurement errors of the measuring instruments, or the non-ejection amount in the case where the flow rate V2 is estimated according to the image data (e.g. the non-ejection amount corresponding to the differential between the estimated value and the actually consumed value). Hence, the ink can be supplied to the recording head 50 in a stable fashion.

In the first pressure control device 104B, although it is possible to use only the measurement results (the liquid volume S in the sub tank 102) from the liquid volume measurement device 132, without using the measurement results (flow rate V2) from the flow rate measurement device 108, this is not suitable since it is difficult to calculate the pressure to be applied to the main tank 100, accurately, to the extent that the supply volume (the flow rate V1) from the main tank 100 to the sub tank 102 comes within a target range.

In the liquid supply apparatus 90B according to the present embodiment, the following procedures are carried out when the main tank is replaced with a new one, or in the event of an abnormality or momentary disconnection.

Figure 16:
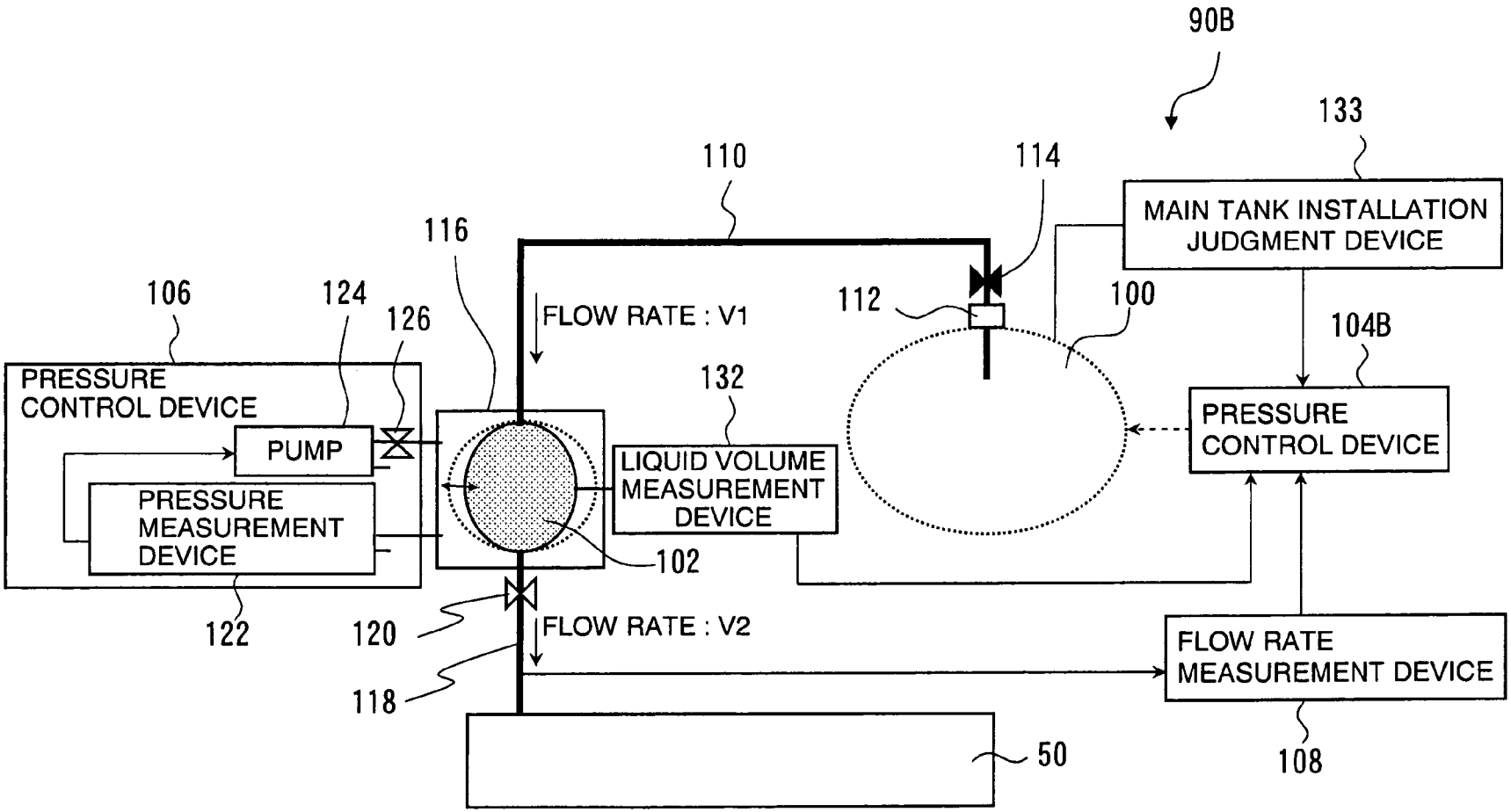
FIG. 16 is a general schematic drawing showing an aspect of the liquid supply apparatus during replacement of the main tank.

FIG. 16 is an approximate diagram showing an aspect of the liquid supply apparatus 90B when the main tank is replaced with a new one. As shown in FIG. 16, when the main tank 100 is detached in order to replace the main tank, the first pressure control device 104B assumes a halted state since the main tank 100, which is a control object thereof, is not present. While the main tank 100 is being detached, a main tank installation judgment device 133 constantly judges whether the main tank 100 is detached or installed, and if the main tank 100 is judged to be installed, then the valve 114 is opened and the operation of the first pressure control device 104B is started.

Figure 17:
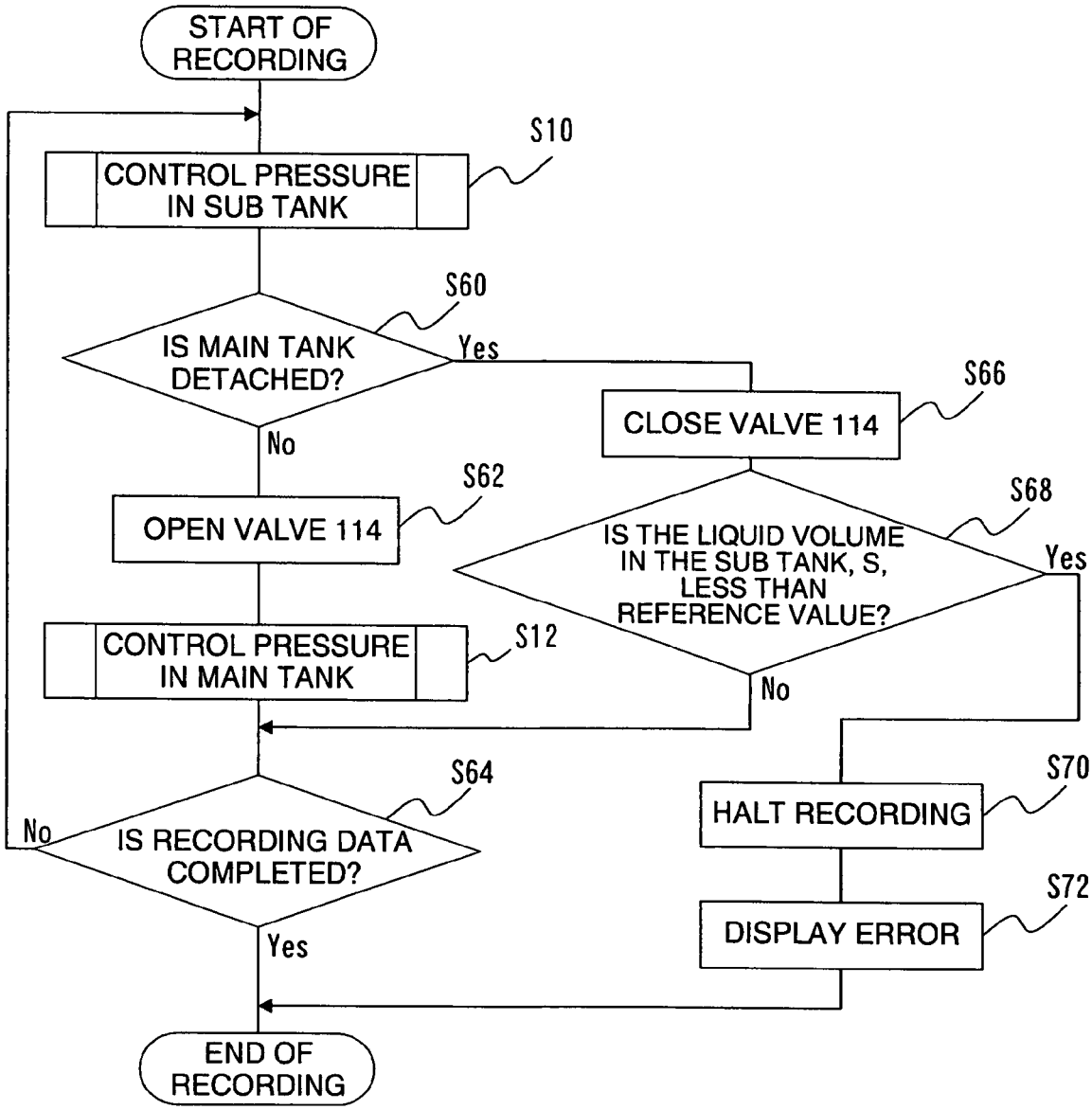
FIG. 17 is a diagram showing a control sequence during replacement of the main tank.

FIG. 17 is a diagram that shows the sequence including the control sequence when the main tank is being replaced with a new one. As shown in FIG. 17, when the recording operation is started, the pressure control for the sub tank 102 is carried out (step S10), and the main tank installation judgment device 133 judges whether or not the main tank 100 is detached (step S60).

If it is judged that the main tank 100 is installed (in other words, "No" verdict is reached in step S60), then the valve 114 is set to an open state (step S62), and pressure control for the main tank 100 is carried out (step S12). It is then judged whether or not the recording data has ended (step S64), and if the recording data has not yet ended ("No" verdict), then the procedure returns to step S10 and similar processing is repeated, whereas if the recording data has ended ("Yes" verdict), then the recording operation is terminated.

If, on the other hand, it is judged that the main tank 100 is detached (in other words, "Yes" verdict is reached in step S60), the valve 114 is closed (step S66), and subsequently, it is judged whether or not the liquid volume S in sub tank 102 is less than a reference value (step S68). If it is judged that the liquid volume S of the sub tank 102 is less than the reference value (in other words, "Yes" verdict is reached in step S68), the recording operation is halted (step S70), an error is displayed on an output device (not illustrated) (step S72), and the recording operation terminates. On the other hand, if it is judged that the liquid volume S in the sub tank 102 is equal to or greater than the reference value (in other words, "No" verdict is reached in step S68), then the procedure progresses to step S64 and it is judged whether or not the recording data has ended. If the recording data has not ended ("No" verdict), then the process returns to step S10 and the process from step S10 is repeated, whereas if the recording data has ended ("Yes" verdict), then the recording operation is terminated.

According to the sequence shown in FIG. 17, it is possible to replace the main tank 100 with a new one during recording without interrupting recording, and it is possible to perform ejection stably from the recording head 50 by adjusting the internal pressure in the sub tank 102.

Figure 18:
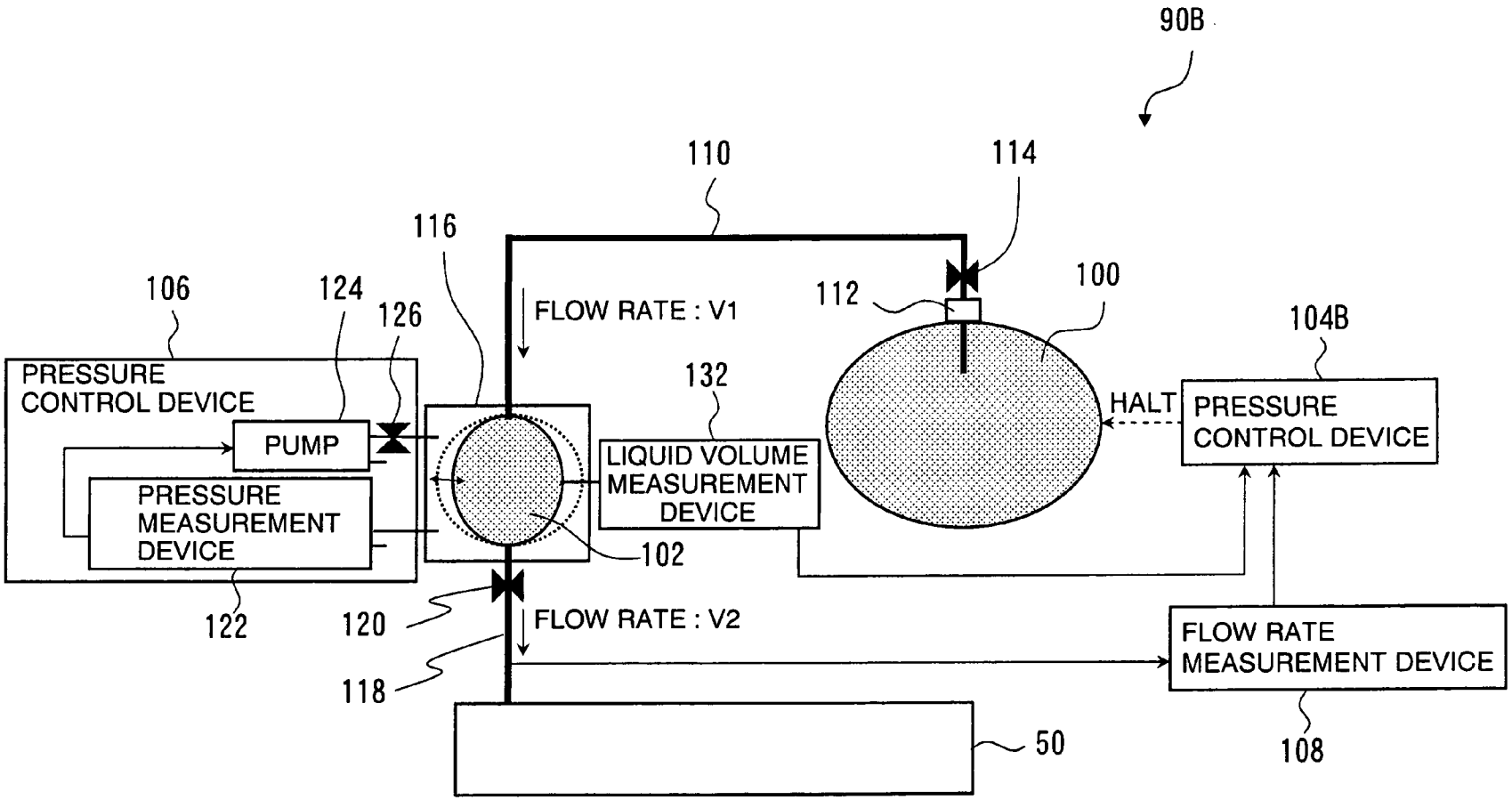
FIG. 18 is a general schematic drawing showing an aspect of the liquid supply apparatus in the event of an abnormality or a momentary interruption.

FIG. 18 is an approximate diagram showing an aspect of the liquid supply apparatus 90B in the event of an abnormality or momentary interruption. As shown in FIG. 18, in the event of an abnormality or a momentary interruption, all of the valves 114, 120 and 126 are closed, and the application of pressure to the main tank 100 by the first pressure control device 104B is halted. By closing all of the valves 114, 120 and 126, it is possible to prevent the leaking of ink from the recording head 50, even if an abnormality occurs or even if a positive pressure is generated on the basis of the water head differential or the residual pressure. On the other hand, when a replacement for the main tank is completed, then the liquid volume S in the sub tank 102 and the pressure differential ΔP between the internal pressure of the sealed container 116 and the atmospheric pressure are measured, and if these measured values lie outside a target range, then they are adjusted to come within the target range before starting a recording operation.

Third Embodiment

Next, a third embodiment of the present invention is described. Below, the description of the parts of this embodiment which are common to those of the above-described embodiments is omitted, and the explanation focuses on the characteristic features of the present embodiment.

Figure 19:
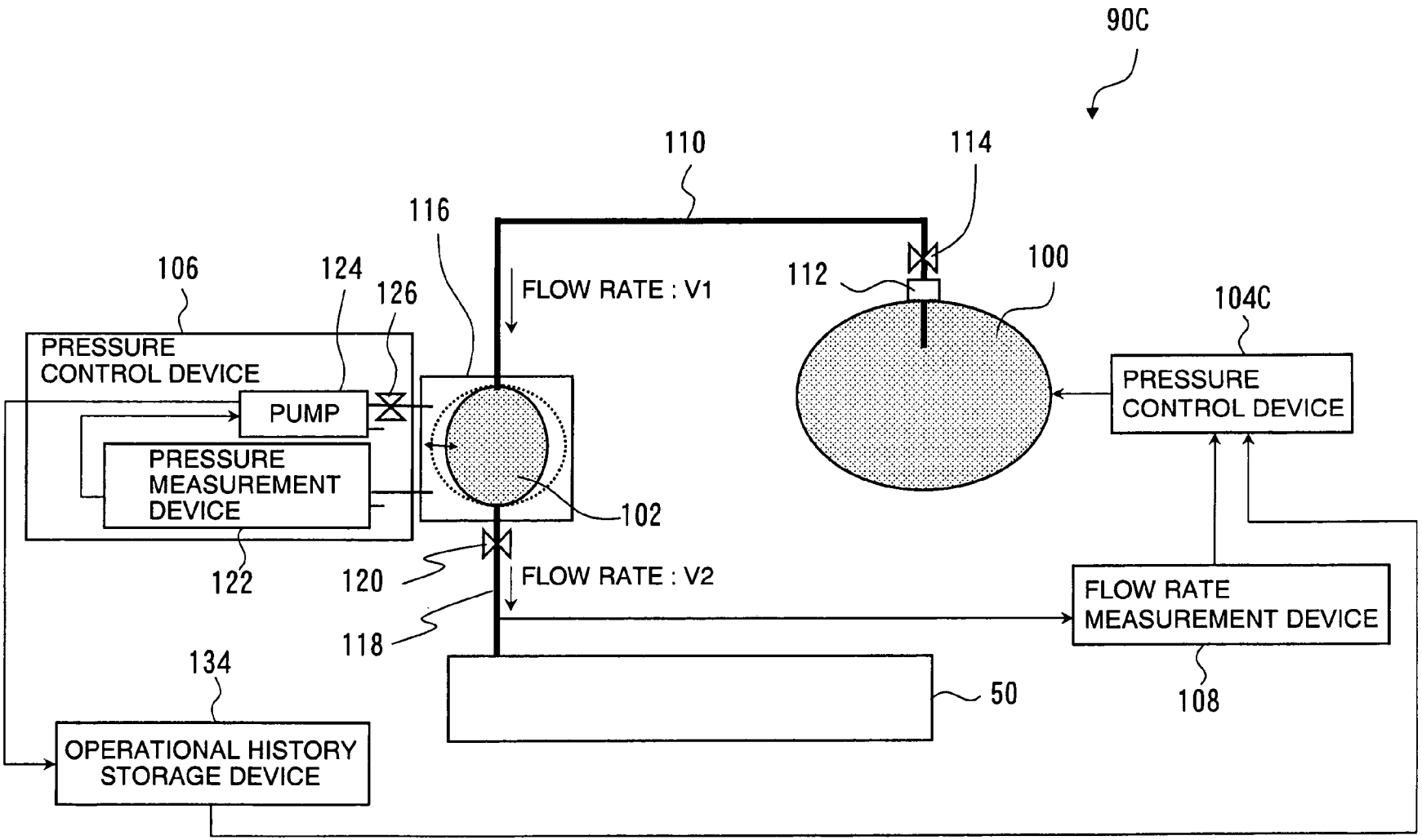
FIG. 19 is a schematic drawing showing the composition of a liquid supply apparatus according to a third embodiment of the present invention.

FIG. 19 is a schematic drawing showing the composition of a liquid supply apparatus 90C according to the third embodiment of the present invention. The liquid supply apparatus 90C according to the third embodiment is different from the liquid supply apparatus 90A according to the first embodiment (see FIG. 6), in that the liquid supply apparatus 90C includes an operational history storage device 134, as shown in FIG. 19.

The operational history storage device 134 is a device which stores the operational history of the pump 124. In the present embodiment, a rotary pump is used as the pump 124. The operational history of the pump 124 includes an operating time of the pump 124. The operating time of the pump 124 is stored in two categories: an operating time during introducing air into the sealed container 116 from the outside; and an operating time during expelling air from the interior of the sealed container 116 to the outside. The storage contents in the operational history storage device 134 (the operational history of the pump 124) are reported to a first pressure control device 104C. It is also possible for the first pressure control device 104C to refer to the storage contents in the operational history storage device 134.

The first pressure control device 104C according to the present embodiment uses the operational history of the pump 124 stored in the operational history storage device 134, as well as the measurement results of the flow rate measurement device 108, to control the internal pressure of the main tank 100.

Figure 20:
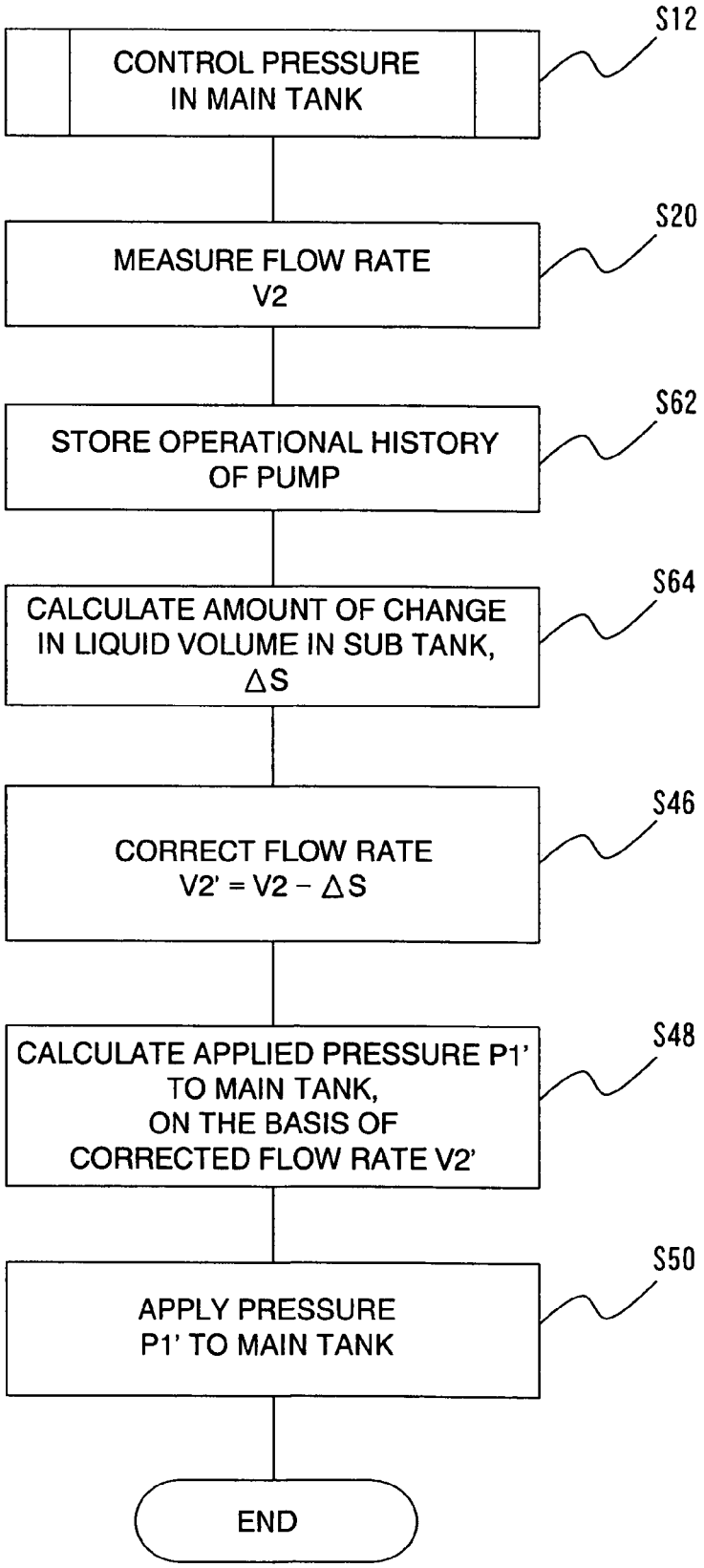
FIG. 20 is a diagram showing the detailed sequence of pressure control for the main tank, according to the third embodiment.

FIG. 20 is a diagram showing the detailed sequence of pressure control for the main tank 100 according to the third embodiment. In FIG. 20, processing steps which are common to those of the above-described embodiments (shown in FIGS. 12 and 14) are labeled with the same reference numerals and further description thereof is omitted here. The control method is adopted that is described above with reference to FIG. 15.

Firstly, similarly to the above-described embodiments, the flow rate V2 is measured (step S20), and the operational history of the pump 124 is then stored in the operational history storage device 134 (step S62). The storage contents in the operational history storage device 134 are reported to the first pressure control device 104C. The first pressure control device 104C calculates the amount of change in the liquid volume of the sub tank 102, ΔS, on the basis of the operational history of the pump 124 (step S64). The steps after calculating the amount ΔS of change in the liquid volume in the sub tank 102 (steps S46 to S50 in FIG. 20) are carried out in a similar fashion to those of the second embodiment described above. Thereupon, the pressure control process for the main tank 100 is terminated.

Figure 21A:
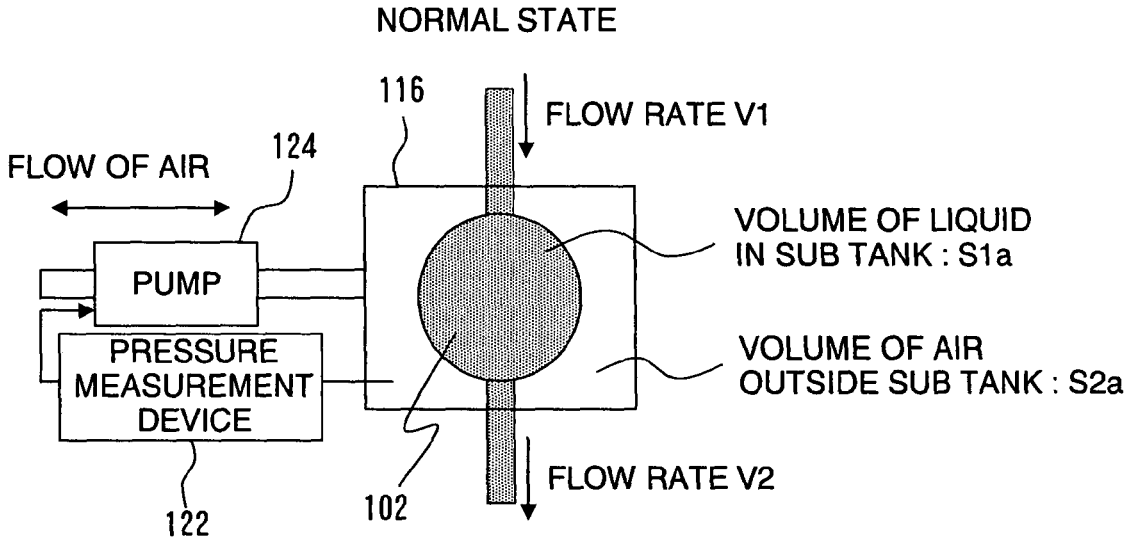
FIGS. 21A and 21B are illustrative diagrams of a method for calculating the amount of change in the liquid volume in the sub tank.
Figure 21B:
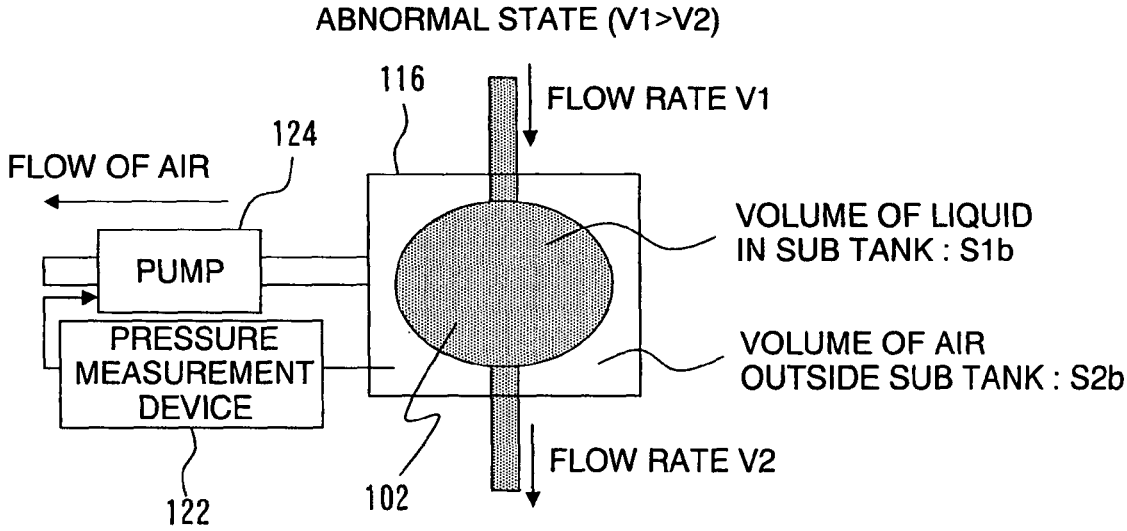

Next, the method for calculating the amount of change in the liquid volume in the sub tank 102, ΔS, on the basis of the operational history of the pump 124 is described below with reference to FIGS. 21A and 21B. FIG. 21A shows a normal state (initial state) in which the liquid volume in the sub tank 102 is represented by S1*a* and the amount of air inside the sealed container 116 (excluding the sub tank 102) is represented by S2*a*. FIG. 21B shows an abnormal state in which the liquid volume in the sub tank 102 is represented by S1*b* and the amount of air inside the sealed container 116 (excluding the sub tank 102) is represented by S2*b*.

If an abnormality, such as an ejection failure, occurs in the recording head 50, then, because of the reduction in the amount of ink consumed by the recording head 50, the flow rate V2 becomes smaller than the flow rate V1(V2<V1) and the liquid volume S1 in the sub tank 102 tends to increase. In the present embodiment, the air is caused to flow out from the interior of the sealed container 116 by means of the second pressure control device 106, and hence the internal pressure of the sub tank 102 does not increase, but rather is kept at a uniform pressure. In this case, the sub tank 102 is disposed inside the sealed container 116, which is rigid (undeformable), and therefore, if the internal pressure of the sub tank 102 remains uniform at the initial value, then the equation "S1*a*+S2*a*=S1*b*+S2*b*" is established. Consequently, it is possible to determine the amount of change in the liquid volume of the sub tank 102, ΔS (=S1*b*−S1*a*), from the outflow volume (i.e., S2*a*−S2*b*) from the interior to the exterior of the sealed container 116 caused by the driving of the pump 124. The outflow volume (i.e., S2*a*−S2*b*) from the interior to the exterior of the sealed container 116 can be calculated from the operating time of the pump 124 which is stored in the operational history storage device 134.

Conversely, in cases where the flow rate V2 has become greater than the flow rate V1 (V2>V1) because of the increase in the amount of ink consumed by the recording head 50, it is still possible to determine the amount of change in the liquid volume of the sub tank 102, ΔS, in a similar fashion.

According to the third embodiment, it is possible to calculate the amount of change in the liquid volume in the sub tank 102, ΔS, from the storage contents (the operational history of the pump 124) in the operational history storage device 134, and therefore it is possible to achieve beneficial effects similar to those of the second embodiment, even if no device is provided for measuring the liquid volume in the sub tank 102. Consequently, it is possible to reduce the costs and the size of the liquid supply apparatus 90C.

Fourth Embodiment

Next, a fourth embodiment of the present invention is described. Below, the description of the parts of this embodiment which are common to those of the above-described embodiments is omitted, and the explanation focuses on the characteristic features of the present embodiment.

Figure 22:
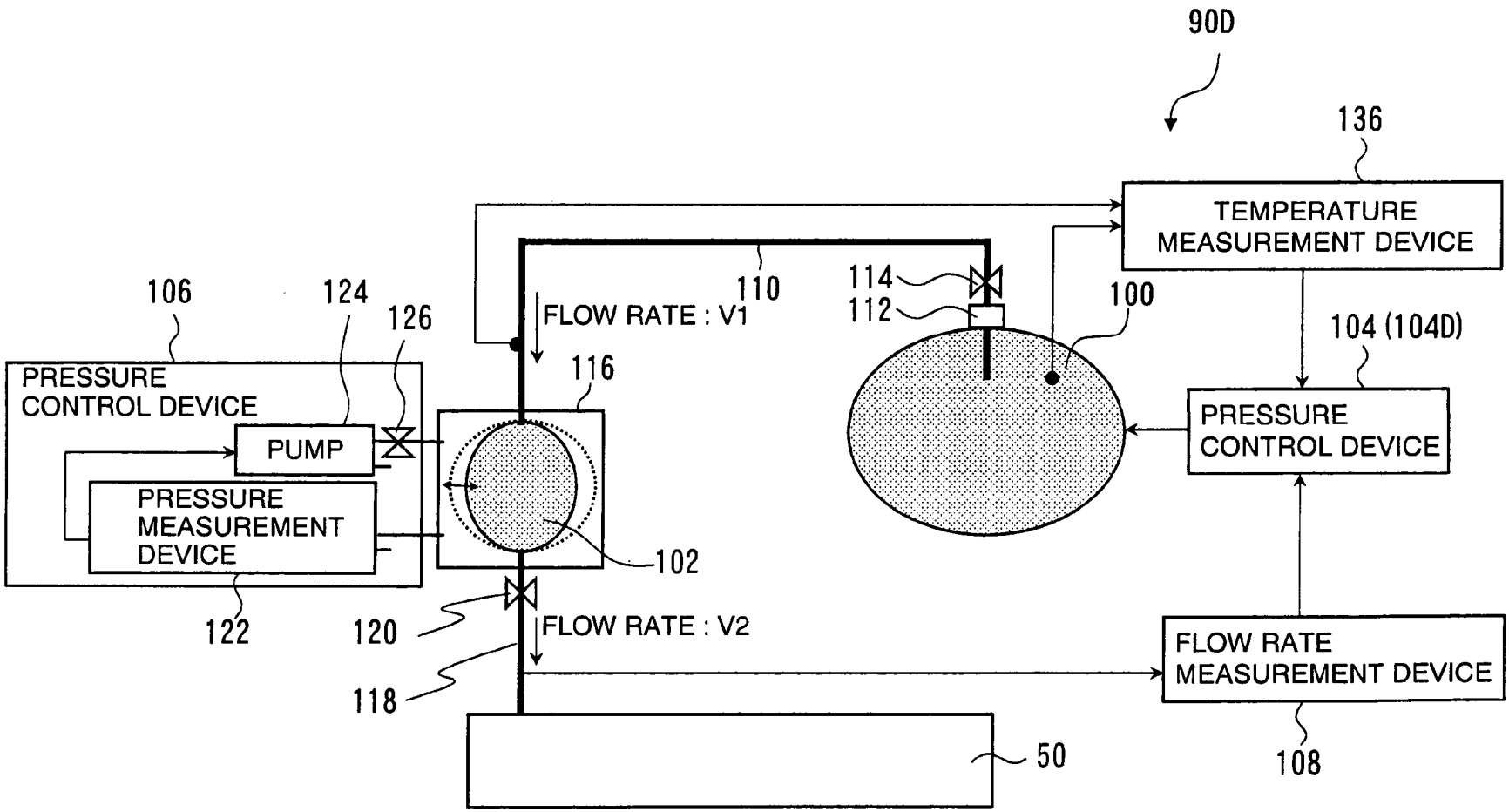
FIG. 22 is a schematic drawing showing the composition of a liquid supply apparatus according to a fourth embodiment of the present invention.

FIG. 22 is a schematic drawing showing the composition of a liquid supply apparatus 90D according to the fourth embodiment of the present invention. The liquid supply apparatus 90D according to the fourth embodiment is different from the liquid supply apparatus 90A according to the first embodiment (shown in FIG. 6), in that the liquid supply apparatus 90D includes a temperature measurement device 136, as shown in FIG. 22.

The temperature measurement device 136 measures the ink temperature in the first flow channel 110. Desirably, the ink temperature in the first flow channel 110 is measured by the temperature measurement device 136, on the downstream side (on the side of the sub tank 102) of the first flow channel 110. It is desirable that the ink temperature in the main tank 100 be also measured. The pressure loss in the first flow channel 110 can thereby be ascertained more accurately. The measurement results (ink temperature) obtained by the temperature measurement device 136 are reported to a first pressure control device 104D.

The first pressure control device 104D according to the present embodiment uses the measurement results of the temperature measurement device 136, as well as the measurement results of the flow rate measurement device 108, in order to control the internal pressure of the main tank 100.

Figure 23:
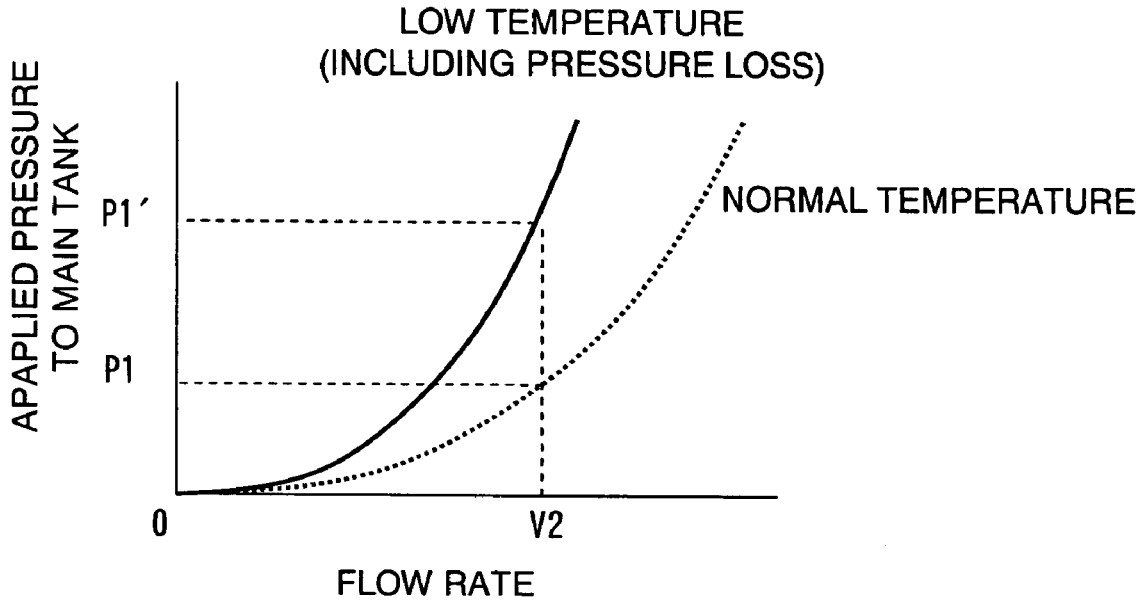
FIG. 23 is a diagram showing an example of the relationship between the flow rate in the second flow channel and the pressure to be applied to the main tank.

FIG. 23 is a diagram showing an example of the relationship between the flow rate in the second flow channel 118 and the pressure to be applied to the main tank 100, the relationship being dependent on the ink temperature: FIG. 23 shows the relationships in the cases of normal ink temperature and low ink temperature. In this fourth embodiment, the ink temperature in the first flow channel 110 is also taken into account. For example, the applied pressure is calculated to be P1 from the flow rate V2 in the case of normal ink temperature. On the other hand, if the ink temperature is a low temperature, then the pressure to be applied to the main tank 100 is calculated to be P1' (>P1) from the flow rate V2, as shown in FIG. 23. In other words, if the ink temperature is low, then the pressure loss in the first flow channel 110 increases due to a rise in the ink viscosity, but by increasing the pressure applied to the main tank 100 in accordance with the amount of increase in the pressure loss, then it is possible to make the flow rate V1 in the first flow channel 110 come within a target range, and hence stable ink supply can be achieved. This applies similarly to a case where the ink temperature is high, in which case similar beneficial effects can be obtained by reducing the pressure applied to the main tank 100 in accordance with the amount of decrease in the pressure loss.

The relationship for a particular ink temperature between the flow rate V2 and the pressure to be applied to the main tank 100, is different for each type of ink. The pressure to be applied to the main tank 100 is desirably determined by referring to the table which is stored in a memory device (not illustrated) in advance and includes data derived from the relationships measured experimentally/statistically.

According to the fourth embodiment, even if a change in the ink viscosity due to a change in the ink temperature occurs, and consequently, a change in the pressure loss in the first flow channel 110 occurs, then by controlling the internal pressure of the main tank 100 in accordance with the ink temperature measured by the temperature measurement device 136, it is possible to keep the flow rate V1 in the first flow channel 110 within a target range, and hence stable ink supply can be achieved.

Fifth Embodiment

Next, a fifth embodiment of the present invention is described. Below, the description of the parts of this embodiment which are common to those of the above-described embodiments is omitted, and the explanation focuses on the characteristic features of the present embodiment.

Figure 24:
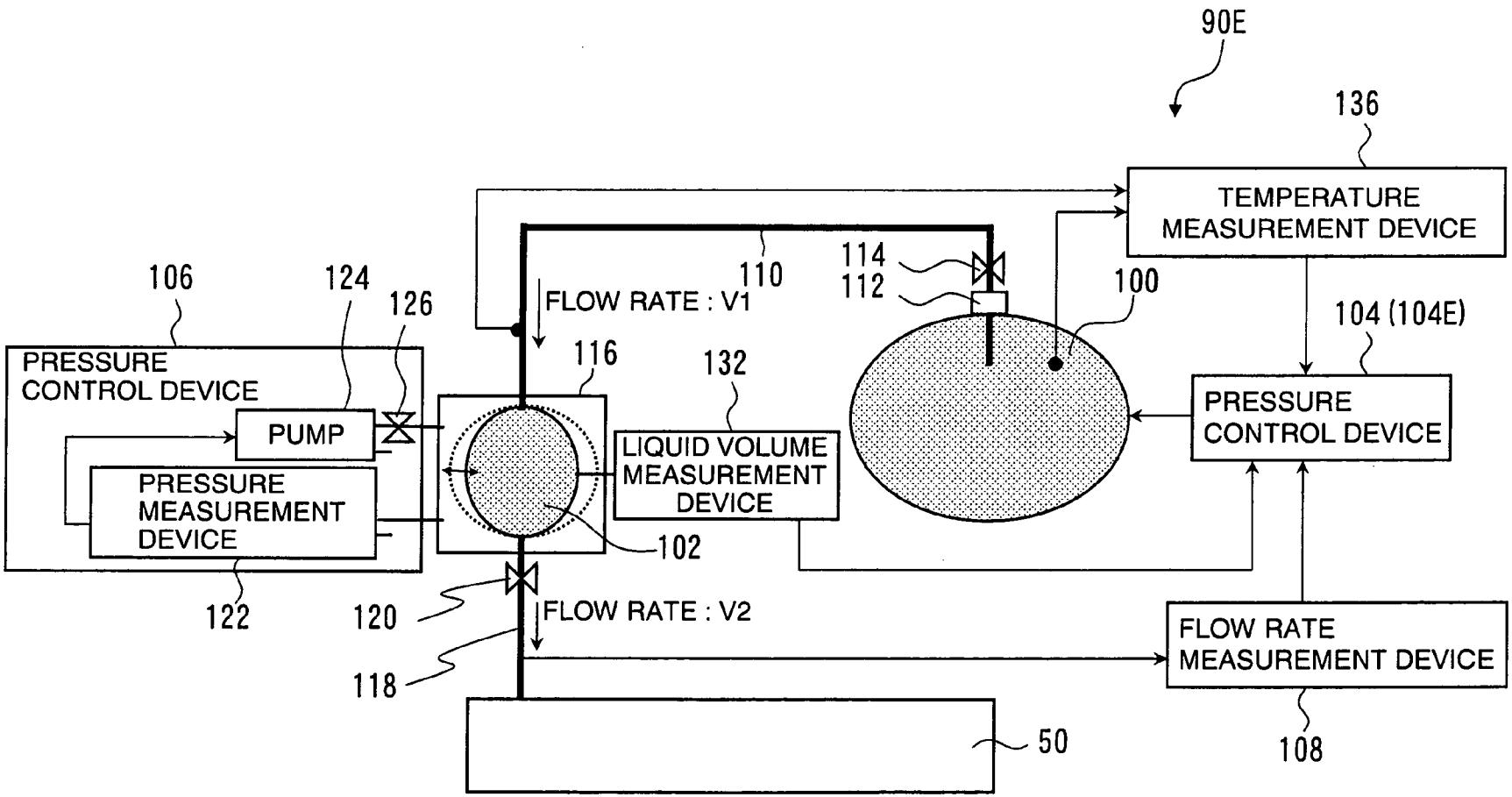
FIG. 24 is a schematic drawing showing the composition of a liquid supply apparatus according to a fifth embodiment of the present invention.

FIG. 24 is a schematic drawing showing the composition of a liquid supply apparatus 90E according to the fifth embodiment of the present invention. The liquid supply apparatus 90E according to the fifth embodiment is different from the liquid supply apparatus 90B according to the second embodiment (shown in FIG. 13), in that the liquid supply apparatus 90E includes a temperature measurement device 136, as shown in FIG. 24.

The temperature measurement device 136 is a device which measures the ink temperature in the first flow channel 110. Desirably, the ink temperature in the first flow channel 110 is measured by the temperature measurement device 136, on the downstream side (on the side of the sub tank 102) of the first flow channel 110. It is also desirable that the ink temperature inside the main tank 100 be also measured. This enables the pressure loss in the first flow channel 110 to be ascertained more accurately. The measurement results (ink temperature) obtained by the temperature measurement device 136 are reported to a first pressure control device 104E.

The first pressure control device 104E according to the present embodiment uses the measurement results of the liquid volume measurement device 132 and the measurement results of the temperature measurement device 136, in addition to the measurement results of the flow rate measurement device 108, in order to control the internal pressure of the main tank 100.

Figure 25:
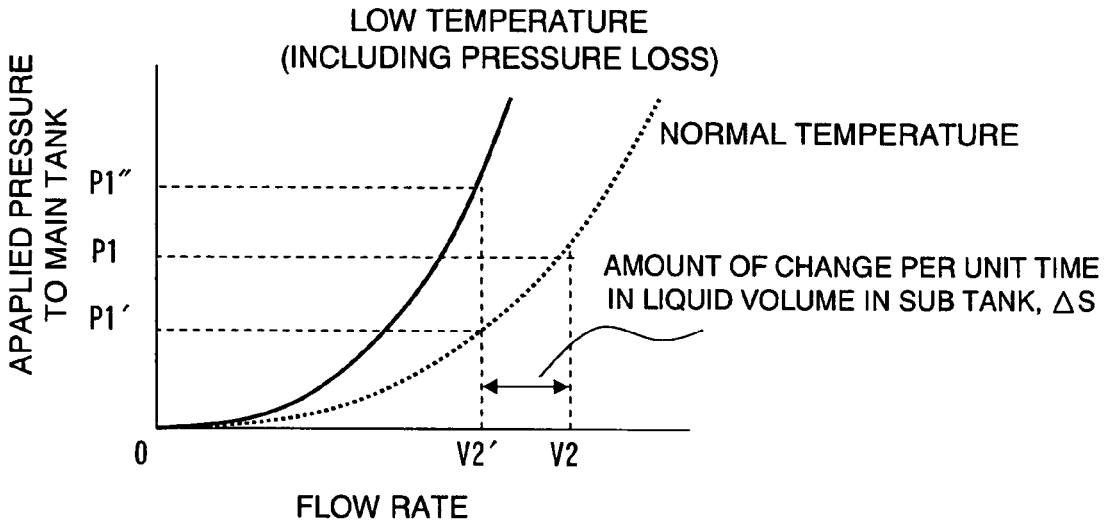
FIG. 25 is a diagram showing an example of the relationship between the flow rate in the second flow channel and the pressure to be applied to the main tank.

FIG. 25 is a diagram showing an example of the relationship between the flow rate in the second flow channel 118 and the pressure to be applied to the main tank 100, the relationship being dependant on the ink temperature: FIG. 25 shows the relationships in the case of normal ink temperature and in the case of low ink temperature. The applied pressure is calculated to be P1 from the flow rate V2, in the case of normal ink temperature. In the second embodiment described above, the pressure to be applied to the main tank 100 is calculated to be P1' (<P1) on the basis of the corrected flow rate V2' obtained by subtracting the amount of change in the liquid volume of the sub tank 102, ΔS, from the flow rate V2. On the other hand, in the fifth embodiment, the ink temperature in the first flow channel 110 is also taken into account, and if the ink temperature is a low temperature, for example, then the pressure to be applied to the main tank 100 is calculated to be P1" (>P1') from the corrected flow rate V2', as shown in FIG. 25. In other words, if the ink temperature is low, then the pressure loss in the first flow channel 110 increases due to a rise in the ink viscosity, but by increasing the pressure to be applied to the main tank 100 in accordance with the amount of increase in the pressure loss, then it is possible to make the flow rate V1 in the first flow channel 110 come within a target range, and hence stable ink supply can be achieved. This applies similarly to a case where the ink temperature is high, in which case similar beneficial effects can be obtained by reducing the pressure to be applied to the main tank 100 in accordance with the amount of decrease in the pressure loss.

The relationship between the flow rate V2 and the pressure to be applied to the main tank 100 for the ink temperatures, is different for each type of ink. The pressure to be applied to the main tank 100 is desirably determined by referring to the table which is stored in a memory device (not illustrated) in advance and includes data derived from the relationships measured experimentally/statistically.

According to the fifth embodiment, even if a change in the ink viscosity occurs due to a change in the ink temperature, and consequently a change in the pressure loss in the first flow channel 110 occurs, then by controlling the internal pressure of the main tank 100 in accordance with the ink temperature measured by the temperature measurement device 136, it is possible to keep the flow rate V1 in the first flow channel 110 within a target range, and hence stable ink supply can be achieved.

Liquid supply apparatuses, image forming apparatuses and liquid supply methods according to the present invention have been described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supply apparatus comprising: a main tank which stores liquid; a sub tank which is disposed vertically above a recording head configured to eject the liquid and which is not connected to atmosphere, the sub tank being composed of a deformable member so that a volume of the sub tank is changed depending on a volume of the liquid in the sub tank;

a first flow channel which connects the main tank with the sub tank;

a second flow channel which connects the sub tank with the recording head;

a flow rate calculation device which calculates a flow rate of the liquid in the second flow channel;

a liquid volume change calculation device which calculates an amount of change per unit time in the volume of the liquid in the sub tank, the calculated amount of change having a positive value when the liquid in the sub tank increases;

a corrected flow rate calculation device which calculates a corrected flow rate of the liquid in the second flow channel by subtracting the calculated amount of change per unit time in the volume of the liquid in the sub tank obtained by the liquid volume change calculation device from the calculated flow rate of the liquid in the second flow channel obtained by the flow rate calculation device;

a first pressure control device which controls an internal pressure of the main tank by applying pressure to the main tank according to the corrected flow rate calculated by the corrected flow rate calculation device so that a greater pressure is applied to the main tank when the corrected flow rate is greater; and a second pressure control device which controls an internal pressure of the sub tank so as to fall within a prescribed range.

2. The liquid supply apparatus as defined in claim 1, further comprising a liquid volume measurement device which measures the volume of the liquid in the sub tank, wherein the liquid volume change calculation device calculates the amount of change per unit time in the volume of the liquid in the sub tank according to the volume of the liquid in the sub tank measured by the liquid volume measurement device.

3. The liquid supply apparatus as defined in claim 1, further comprising an operational history storage device which stores an operational history of the second pressure control device, wherein the liquid volume change calculation device calculates the amount of change per unit time in the volume of the liquid in the sub tank according to the operational history stored in the operational history storage device.

4. The liquid supply apparatus as defined in claim 1, further comprising a temperature measurement device which measures a temperature of the liquid in the first flow channel, wherein the first pressure control device controls the internal pressure of the main tank according to the temperature of the liquid measured by the temperature measurement device so that a greater pressure is applied to the main tank when the measured temperature is lower.

5. An image forming apparatus comprising the liquid supply apparatus as defined in claim 1.

6. A liquid supply method for a liquid supply apparatus including: a main tank which stores liquid; a sub tank which is disposed vertically above a recording head configured to eject the liquid and which is not connected to atmosphere, the sub tank being composed of a deformable member so that a volume of the sub tank is changed depending on a volume of the liquid in the sub tank; a first flow channel which connects the main tank with the sub tank; and a second flow channel which connects the sub tank with the recording head, the liquid supply method comprising:

a flow rate calculation step of calculating a flow rate of the liquid in the second flow channel;

a liquid volume change calculation step of calculating an amount of change per unit time in the volume of the liquid in the sub tank, the calculated amount of change having a positive value when the liquid in the sub tank increases;

a corrected flow rate calculation step of calculating a corrected flow rate of the liquid in the second flow channel by subtracting the calculated amount of change per unit time in the volume of the liquid in the sub tank obtained in the liquid volume change calculation step from the calculated flow rate of the liquid in the second flow channel obtained in the flow rate calculation step;

a first pressure control step of controlling an internal pressure of the main tank by applying pressure to the main tank according to the corrected flow rate of the liquid in the second flow channel calculated in the corrected flow rate calculation step so that a greater pressure is applied to the main tank when the corrected flow rate is greater; and a second pressure control step of controlling an internal pressure of the sub tank so as to fall within a prescribed range.

7. The liquid supply apparatus as defined in claim 1, further comprising:

a propeller arranged in the second flow channel, wherein the flow rate calculation device measures a number of rotations of the propeller, and calculates the flow rate of the liquid in the second flow channel in accordance with the measured number of rotations of the propeller.

8. The liquid supply apparatus as defined in claim 1, further comprising:

a floating member arranged in the second flow channel, wherein the flow rate calculation device measures a level of elevation of the floating member, and calculates the flow rate of the liquid in the second flow channel in accordance with the measured level of elevation of the floating member.

9. The liquid supply apparatus as defined in claim 1, further comprising:

a pair of pressure measurement devices arranged in the second flow channel, wherein the flow rate calculation device measures a pressure differential between the pair of pressure measurement devices, and calculates the flow rate of the liquid in the second flow channel in accordance with the measured pressure differential.

10. The liquid supply apparatus as defined in claim 1, wherein the flow rate calculation device receives data by which the recording head is controlled to eject the liquid, and the flow rate calculation device calculates the flow rate of the liquid in the second flow channel in accordance with the received data.

11. The liquid supply method as defined in claim 6, wherein the flow rate calculation step includes the steps of:

measuring a number of rotations of a propeller arranged in the second flow channel; and calculating the flow rate of the liquid in the second flow channel in accordance with the measured number of rotations of the propeller.

12. The liquid supply method as defined in claim 6, wherein the flow rate calculation step includes the steps of:

measuring a level of elevation of a floating member arranged in the second flow channel; and calculating the flow rate of the liquid in the second flow channel in accordance with the measured level of elevation of the floating member.

13. The liquid supply method as defined in claim 6, wherein the flow rate calculation step includes the steps of:

measuring a pressure differential between a pair of pressure measurement devices arranged in the second flow channel; and calculating the flow rate of the liquid in the second flow channel in accordance with the measured pressure differential.

14. The liquid supply method as defined in claim 6, wherein the flow rate calculation step includes the steps of:

receiving data by which the recording head is controlled to eject the liquid; and calculating the flow rate of the liquid in the second flow channel in accordance with the received data.

15. The liquid supply method as defined in claim 6, further comprising a liquid volume measurement step of measuring the volume of the liquid in the sub tank, wherein in the liquid volume change calculation step, the amount of change per unit time in the volume of the liquid in the sub tank is calculated according to the volume of the liquid in the sub tank measured in the liquid volume measurement step.

16. The liquid supply method as defined in claim 6, further comprising an operational history storage step of storing an operational history of the second pressure control step, wherein in the liquid volume change calculation step, the amount of change per unit time in the volume of the liquid in the sub tank is calculated according to the operational history stored in the operational history storage step.

17. The liquid supply method as defined in claim 6, further comprising a temperature measurement step of measuring a temperature of the liquid in the first flow channel, wherein in the first pressure control step, the internal pressure of the main tank is controlled according to the temperature of the liquid measured in the temperature measurement step so that a greater pressure is applied to the main tank when the measured temperature is lower.

* * * * *